US005731263A

United States Patent [19]

Totsuka et al.

[11] Patent Number: 5,731,263

[45] Date of Patent: Mar. 24, 1998

[54] IMAGE FORMING METHOD

[75] Inventors: Mikio Totsuka; Toshiharu Tanaka; Yonosuke Takahashi; Shinichi Yoshinari, all of Shizuoka, Japan

[73] Assignee: Fuji Photo Film Co., Ltd., Kanagawa, Japan

[21] Appl. No.: 637,526

[22] Filed: Apr. 25, 1996

[30] Foreign Application Priority Data

Apr. 25, 1995 [JP] Japan ..... 7-124452
Sep. 1, 1995 [JP] Japan ..... 7-248382

[51] Int. Cl.[6] ..... B41M 5/035; B41M 5/38

[52] U.S. Cl. ..... 503/227; 428/195; 428/304.4; 428/913; 428/914; 430/256; 430/326

[58] Field of Search ..... 8/471; 428/195, 428/304.4, 913, 914; 503/227

[56] References Cited

U.S. PATENT DOCUMENTS 5,244,861 9/1993 Campbell et al. ..... 503/227

*Primary Examiner*—Bruce H. Hess
*Attorney, Agent, or Firm*—Birch, Stewart, Kolasch & Birch, LLP

[57] ABSTRACT

A heat sensitive ink sheet has a heat sensitive ink layer which is formed of a heat sensitive ink material comprising colored pigment and thermoplastic resin such as amorphous organic polymer. An image receiving sheet having a support sheet and an image receiving layer thereon, the support sheet of the image receiving sheet being a porous sheet made of plastics which have fine pores therein. An image forming method is conducted by using the heat sensitive ink sheet and an image receiving sheet by area gradation by the use of a thermal head or laser beam.

19 Claims, 4 Drawing Sheets

Particle Size Distribution

Particle Size Distribution

Particle Size Distribution

IMAGE FORMING METHOD

FIELD OF THE INVENTION

This invention relates to an image forming method and a composite of a heat sensitive ink sheet and an image receiving sheet favorably employable for the method. In more detail, the invention relates to an image forming method for forming a multicolor image on an image receiving sheet by area gradation using a thermal head or laser beam.

BACKGROUND OF THE INVENTION

Heretofore, there have been known two methods for thermal transfer recording for the preparation of a multicolor image which utilize a thermal head printer, that is, a sublimation dye transfer recording method and a fused ink transfer recording method.

The sublimation dye transfer recording method comprises the steps of superposing on an image receiving sheet an image transfer sheet which is composed of a support and an image transfer layer comprising a sublimation ink and a binder and imagewise heating the support of the transfer sheet to sublimate the sublimation ink to form an image on the image receiving sheet. A multicolor image can be prepared using a number of color transfer sheets such as a yellow transfer sheet, a magenta transfer sheet, and a cyan transfer sheet.

The sublimation dye transfer recording method, however, has the following drawbacks:

1) The gradation of image is mainly formed of variation of the sublimated dye concentration, which is varied by controlling the amount of sublimation of the dye. Such gradation is appropriate for the preparation of a photographic image, but is inappropriate for the preparation of a color proof which is utilized in the field of printing and whose gradation is formed of dots, lines, or the like, that is, area gradation.
2) The image formed of sublimated dye has poor edge sharpness, and a fine line shows thinner density on its solid portion than a thick line. Such tendency causes serious problem in the quality of character image.
3) The image of sublimated dye is poor in endurance. Such image cannot be used in the fields which require multicolor images resistant to heat and light.
4) The sublimation dye transfer recording shows sensitivity lower than the fused ink transfer recording. Such low sensitive recording method is not preferably employable in a high speed recording method utilizing a high resolution thermal head, of which development is expected in the future.
5) The recording material for the sublimation dye transfer recording is expensive, as compared with the recording material for the fused ink transfer recording.

The fused ink transfer recording method comprises the steps of superposing on an image receiving sheet an image transfer sheet having support and a thermal fusible transfer layer which comprises a coloring material (e.g., pigment or dye) and imagewise heating the support of the transfer sheet to portionwise fuse the transfer layer to form and transfer an image onto the image receiving sheet. A multicolor image also can be prepared using a number of color transfer sheets.

The fused ink transfer recording method is advantageous in the sensitivity, cost, and endurance of the formed image, as compared with the sublimation dye transfer recording method. It, however, has the following drawbacks:

The color image prepared by the fused ink transfer recording method is poor in its quality, as compared with the sublimation dye transfer recording method. This is because the fused ink transfer recording utilizes not gradation recording but binary (i.e., two valued) recording. Therefore, there have been reported a number of improvements on the fusible ink layer of the fused ink transfer recording method for modifying the binary recording to give gradation recording so that a color image having multi-gradation is preparedly the fused ink transfer recording method. The basic concept of the heretofore reported improvement resides in portionwise (or locally) controlling the amount of the ink to be transferred onto the image receiving sheet. In more detail, the mechanism of transfer of the ink in the fused ink transfer recording method is as follows; under heating by the thermal head, the viscosity of the ink layer at the site in contact with the thermal head lowers and the ink layer tends to adhere to the image receiving sheet, whereby the transfer of the ink takes place. Therefore, the amount of the transferred ink can be controlled by varying degree of elevation of temperature on the thermal head so that the cohesive failure in the ink layer is controlled and the gamma characteristic of the transferred image is varied. Thus, the optical density of the transferred ink image is portionwise varied, and accordingly, an ink image having gradation is formed. However, the optical density of a fine line produced by the modified fused ink transfer recording is inferior to that produced by the sublimation dye transfer recording method. Moreover, the optical density of a fine line produced by the modified fused ink transfer recording method is not satisfactory.

Further, the fused ink transfer recording method has other disadvantageous features such as low resolution and poor fixation of the transferred ink image. This is because the ink layer generally uses crystalline wax having a low melting point as the binder, and the wax tends to spread on the receiving sheet in the course of transferring under heating. Furthermore, the crystalline wax scarcely gives a transparent image due to light scattering on the crystalline phase. The difficulty in giving a transparent image causes serious problems in the preparation of a multicolor image which is formed by superposing a yellow image, a magenta image, and a cyan image. The requirement to the transparency of the formed image restricts the amount of a pigment to be incorporated into the ink layer. For instance, Japanese Patent Publication No. 63(1988)-65029 describes that the pigment (i.e., coloring material) should be incorporated in the ink layer in an amount of not more than 20 weight % based on the total amount of the ink layer. If an excessive amount of the pigment is employed, the transparency of the transferred ink image is made dissatisfactory.

Improvements of reproduction of a multicolor image in the fused ink transfer recording have been studied and proposed, so far. For instance, Japanese Patent Provisional Publication No. 61(1986)-244592(=Japanese Patent Publication No. 5(1993)-13072) describes a heat sensitive recording material which has a heat sensitive layer comprising at least 65 weight % of an amorphous polymer, a releasing agent, and a coloring material (dye or pigment) which can reproduce a color image having continuous gradation with improved transparency and fixation strength. The publication indicates that the amorphous polymer in an amount of 65 weight % gives a heat sensitive ink layer of extremely poor transparency and therefore cannot reproduce a satisfactory color image, and at least 70 weight % of the amorphous polymer is required to give a sufficiently transparent ink layer. Further, the amount of the coloring material is required to be not more than 30 weight % to obtain the sufficiently transparent ink layer. As for the thickness of the heat-sensitive ink layer, it is described that 0.5 μm to 50 μm, specifically 1 μm to 20 μm, is preferred to obtain practical density or strength of an image. In the working examples, the thickness of the ink layer is approximately 3 μm which is similar to that of the conventional ink layer using wax binder. Furthermore, the publication indicates that the heat sensitive recording material can also utilize binary recording and multi-valued recording (i.e., image recording method utilizing multi-dots having area different from one another; VDS (Variable Dot System)).

The study of the inventors has clarified that recording by the continuous gradation using the heat sensitive recording material of the publication does not give an image having satisfactory continuity and stability of density. Further, the binary or multi-valued recording using the heat sensitive recording material does not give an image having satisfactory continuity of density, transparency (especially transparency of multicolor image) and sharpness in the edge portion.

In contrast, it is known that a thermal transfer recording method can prepare a multicolor image having multi-gradation by means of the multi-valued recording which utilizes area gradation. Further, it is also known that a heat sensitive ink sheet which can be used in the multi-valued recording utilizing area gradation, preferably have the following characteristics:

(1) Each color image (i.e., cyan image, magenta image or yellow image) of the multicolor image for color proofing should have a reflection density of at least 1.0, preferably not less than 1.2, and especially not less than 1.4, and a black image preferably has a reflection density of not less than 1.5. Thus, it is desired that the heat sensitive ink sheet has the above reflection densities.

(2) An image which is produced by area gradation is satisfactory.

(3) An image can be produced in the form of dots, and the formed line or point has high sharpness in the edge.

(4) An ink layer (image) transferred has high transparency.

(5) An ink layer has high sensitivity.

(6) An image transferred onto a white paper (e.g., coated paper) should be analogous to a printed image in tone and surface gloss.

As for the thermal head printer, the technology has been very rapidly developed. Recently, the thermal head is improved to give a color image with an increased resolution and multi-gradation which is produced by area gradation. The area gradation means gradation produced not by variation of optical density in the ink area but by size of ink spots or lines per unit area. Such technology is described in Japanese Patent Provisional Publications No. 4(1992)-19163 and No. 5(1993)-155057 (for divided sub-scanning system) and the preprint of Annual Meeting of Society of Electrography (Jul. 6, 1992)(for heat concentrated system).

The image receiving sheet (materials to be transferred) in the transfer image forming method, usually has a structure wherein an adhesive layer (image receiving layer) containing an organic polymer is provided on a support, in order to prevent occurrence of uneven transfer and transferring error of dot which are originated from evenness or ink-receivable properties of the surface of the image receiving layer (U.S. Pat. Nos. 4,482,625, 4,766,053 and 4,933,258). As materials for the image receiving sheet, a paper, a synthetic paper and polymer films are usually employed. Especially, polyethylene terephthalate film is advantageously employed due to excellent heat resistance property, even surface and low cost.

As a transfer image forming method using the heat sensitive ink sheet, recently a method using a laser beam (i.e., digital image forming method) has been developed. The method comprises the steps of: superposing the heat sensitive ink layer of the heat sensitive ink sheet on an image receiving sheet, and applying a laser beam modulated by digital signal onto the heat sensitive ink layer through the support of the heat sensitive ink sheet to form and transfer an image of the heat sensitive ink layer onto the image receiving sheet (the image can be further retransferred onto other sheet). In the method, the heat sensitive ink sheet generally has a light-heat conversion layer provided between the ink layer and the support to efficiently convert light energy of laser beam into heat energy. The light-heat conversion layer is a thin layer made of carbon black or metal. Further, a method for locally peeling the ink layer to transfer the peeled ink layer onto the image receiving sheet (i.e., ablation method), which does not fuse the layer in the transferring procedure, is disclosed in Japanese Patent Provisional Publication No. 6(1994)-219052. The method is utilized in order to enhance image quality such as evenness of reflection density of the image or sharpness in edges of the image.

The image receiving sheet (materials to be transferred) in the transfer image forming method using a laser beam mentioned above, usually has a structure wherein an adhesive layer (image receiving layer) containing an organic polymer is provided on a support, in order to prevent occurrence of uneven transfer and transferring error of dot which are originated from evenness or ink-receivable properties of the surface of the image receiving layer, as described in the Publication (No. 6(1994)-219052). Further, as materials for the image receiving sheet, a paper, a synthetic paper and a polymer films (e.g., polyethylene terephthalate, polycarbonate, polyethylene, polyvinyl chloride, polyvinylidene chloride, polystyrene and styrene/acrylonitrile copolymer) are usually employed. Especially, the Publication describes a biaxially oriented polyethylene terephthalate film is preferably employable due to good dimensional resistance to moisture or heat.

SUMMARY OF THE INVENTION

The known image forming methods using a thermal head do not satisfactorily give an image which has dots having preferable size and shape and good reproduction of gradation and which is well analogous to a printed image. The copending application discloses that a thin layer heat-sticking-peeling method (i.e., method using a heat sensitive sheet provided with a thin ink layer containing pigment in high content) is advantageous for giving an image having excellent characteristics described above (see U.S. application Ser. No. 08/327,409 or EP Application No. 94116673.8). The use of the above heat sensitive ink sheet gives a high quality color or monochrome image with multi-gradation which is produced by area gradation, and therefore the ink sheet is useful for not only the usual image forming method but also preparation of color proof in the printing field and block copy. Further, the pigments contained in the ink sheet have good durability and therefore the ink sheet is also useful for preparation of elements employed in the fields of the recordable or recorded card and outdoor or meter display.

In order to further improve quality of an image with multi-gradation which is produced by area gradation, desired are the improvements of the image receiving sheet as well as the heat sensitive ink sheet. In more detail, quality of the resultant image varies depending upon the transferring property (i.e., adhesion between the ink layer and the image receiving layer).

In the above thin layer heat-sticking-peeling method, various image defects (e.g., nonuniformity of concentration and occurrence of line) are almost produced depending on the properties of material or surface of the image receiving sheet. The image defects reduce the quality of the final image which is formed on a white paper sheet. Otherwise, in a heat transferring procedure using a thermal transfer printer, the image receiving sheet occasionally lodges (stops running) in the thermal transfer printer during running of the sheet. Further, the image receiving sheet also tends to bring about occurrence of other trouble (e.g., trouble on feeding the sheet) during running of the sheet.

An object of the present invention is to provide an image forming method which is improved in transfer properties in a thermal transfer recording method using a heat sensitive ink layer of a heat sensitive ink sheet satisfying the characteristics described above (1) to (6), and which is capable of forming a transferred image by multi-gradation.

Another object of the invention is to provide an image forming method capable of giving an image which has dots having preferable size and shape (i.e., near to predetermined size and shape) and good reproduction of gradation and which is well analogous to a printed image.

A further object of the invention is to provide a composite of a heat sensitive ink sheet and an image receiving sheet which is suitable for the above image forming method.

A still further object of the invention is to provide an image forming method using a laser beam which is capable of recording uniformly an image in high sensitivity and giving an image of high quality in which image defect is reduced.

The inventors have studied to obtain an image of high quality in which image defect is reduced in the thin layer heat-sticking-peeling method. As a result, the inventors have found that the satisfactory image can be obtained by the use of a sheet made of plastics which have fine pores therein as a support sheet of the image receiving sheet, in the thin layer heat-sticking-peeling method. In more detail, the use of the plastic sheet having fine pores gives cushion property to the image receiving layer of the image receiving sheet, and therefore pressing by the thermal head in the transfer procedure brings about high and even adhesion between the ink layer and the image receiving layer. Hence, the composite (of an image receiving sheet and heat sensitive ink sheet) is improved in ability following up heat information given by the thermal head, which results in reduction of image defects. Further, the use of the plastic sheet having fine pores also softness the image receiving sheet per se, and therefore scarcely brings about occurrence of trouble during running of the sheet in a thermal transfer printer. Furthermore, when a relatively large dust is incorporated between the heat sensitive ink sheet and the image receiving sheet in the procedure that the heat sensitive ink sheet is superposed on the image receiving sheet, the soft sheet almost absorbs the deformation to be formed between the sheets in the procedure to reduce defects of the resultant image.

Moreover, the present inventors have found that the plastic sheet having fine pores is useful in an image forming method using a laser beam. When a laser beam is irradiated on the heat sensitive ink layer of the composite (heat sensitive ink sheet and image receiving sheet) through a back of the image receiving sheet, the heat sensitive ink layer shows high sensibility because the image receiving sheet of the composite has low heat conductivity due to fine pores. In more detail, thermal energy given on the heat sensitive ink sheet scarcely shows loss by heat diffusion due to low heat conductivity of the plastic sheet (support sheet), and therefore a temperature in the irradiated area at the interface between the heat sensitive ink layer and image receiving layer increases compared with in the case of the use of a conventional image receiving sheet, whereby the heat sensitive ink layer is rendered highly sensitive. Furthermore, advantages given in the image forming method using thermal head (e.g., reduction of image defects by enhanced ability following up heat information of a laser beam and little occurrence of trouble during running of the sheet in a printer) can be also obtained in the case of using a laser beam.

There is provided by the present invention an image forming method which comprises the steps of:

superposing a heat sensitive ink sheet having a base sheet and a heat sensitive ink layer thereon on an image receiving sheet having a support sheet and an image receiving layer thereon in such a manner that the heat sensitive ink layer is in contact with the image receiving layer, said heat sensitive ink layer of the heat sensitive ink sheet having a thickness of 0.2 to 1.0 μm and being formed of a heat sensitive ink material which comprises 30 to 70 weight % of colored pigment and 25 to 65 weight % of amorphous organic polymer having a softening point of 40° to 150° C., and said support sheet of the image receiving sheet comprising a porous sheet made of plastics;

placing imagewise a thermal head on the base sheet of the heat sensitive ink sheet to form an image of the ink material with area gradation on the image receiving layer; and separating the base sheet of the heat sensitive ink sheet from the image receiving sheet so that the image of the ink material can be retained on the image receiving layer, said image of the ink material on the image receiving layer having an optical reflection density of at least 1.0.

The preferred embodiments of the above-mentioned image forming method are as follows:

1) The image forming method which further contains the steps of:

superposing the image receiving sheet having the image on a white paper sheet in such a manner that the image of the ink material is in contact with a surface of the white paper sheet; and separating the image receiving sheet from the white paper sheet, keeping the image of the ink material on the white paper sheet preferably said image of the ink material on the white paper sheet having an optical reflection density of at least 1.0.

2) The image forming method wherein at least 70 weight % of the colored pigment has a particle size of 0.1 to 1.0 μm.

3) The image forming method wherein the support sheet of the image receiving sheet is made of at least one material selected from the group consisting of polyester, polyamide, polycarbonate, polyethersulfone, polyimide, polyolefin, polyvinyl chloride, polyurethane, polyvinylidene chloride, polyacrylate and cellulose acetate.

4) The image forming method wherein the support sheet of the image receiving sheet has a thickness of 50 to 250 μm.

5) The image forming method wherein the support sheet of the image receiving sheet is a porous sheet which is sandwiched between a backing layer and an anti-curling layer, the image receiving layer being not provided on the backing layer, and the image receiving layer being provided on the curling layer.

6) The image forming method wherein the image receiving layer of the image receiving sheet comprises at least two layers (preferably comprises a first image receiving layer and a second image receiving layer).

7) The image forming method wherein the heat sensitive ink contains an amide compound having the formula (I):

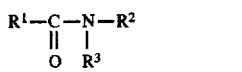

$$R^1-\underset{\underset{O}{\|}}{C}-\underset{\underset{R^3}{|}}{N}-R^2 \quad (I)$$

in which $R^1$ represents an alkyl group of 8 to 24 carbon atoms, an alkoxyalkyl group of 8 to 24 carbon atoms, an alkyl group of 8 to 24 carbon atoms having a hydroxyl group, or an alkoxyalkyl group of 8 to 24 carbon atoms having a hydroxyl group, and each of $R^2$ and $R^3$ independently represents a hydrogen atom, an alkyl group of 1 to 12 carbon atoms, an alkoxyalkyl of 1 to 12 carbon atoms, an alkyl group of 1 to 12 carbon atoms having a hydroxyl group, or an alkoxyalkyl group of 1 to 12 carbon atoms having a hydroxyl group, provided that $R^1$ is not the alkyl group in the case that $R^2$ and $R^3$ both represent a hydrogen atom.

8) The image forming method wherein the amorphous organic polymer is butyral resin or styrene/maleic acid half-ester resin.

9) The image forming method wherein the heat sensitive ink sheet has a thickness of 0.2 to 0.6 μm.

The following image receiving sheet is advantageously employed in the above image forming method of the invention:

The image forming method which comprises a support sheet comprising a porous sheet made of plastics and an image receiving layer provided thereon, wherein the support sheet of the image receiving sheet is a porous sheet which is sandwiched between a backing layer and an anti-curling layer.

The following composite is advantageously employed in the above image forming method of the invention:

The composite in which comprises an image receiving sheet having a support sheet and an image receiving layer thereon and a heat sensitive ink sheet having a base sheet and a heat sensitive ink layer thereon which are superposed in such a manner that the heat sensitive ink layer is in contact with the image receiving layer, said heat sensitive ink layer of the heat sensitive ink sheet having a thickness of 0.2 to 0.1 μm and being formed of a heat sensitive ink material comprising 30 to 70 weight % of colored pigment and 25 to 65 weight % of amorphous organic polymer having a softening point of 40° to 150° C., and said support sheet of the image receiving sheet comprising a porous sheet made of plastics.

The preferred embodiments of the above-mentioned composite are the same as described above 2) to 7).

There is also provided by the present invention an image forming method which comprises the steps of:

superposing a heat sensitive ink sheet having a base sheet and a heat sensitive ink layer thereon on an image receiving sheet having a support sheet and an image receiving layer in such a manner that the heat sensitive ink layer is in contact with the image receiving layer, said heat sensitive ink layer of the heat sensitive ink sheet being formed of a heat sensitive ink material which comprises colored pigment and thermoplastic resin and said support sheet of the image receiving sheet comprising a porous sheet made of plastics;

irradiating a laser beam modulated by digital signals on the heat sensitive ink layer through the base sheet of the heat sensitive ink sheet to form an image of the ink material on the image receiving layer; and separating the base sheet of the heat sensitive ink sheet from the image receiving sheet so that the image of the ink material can be retained on the image receiving sheet (it is preferred that said image of the ink material on the image receiving layer has an optical reflection density of at least 0.5).

The preferred embodiments of the above-mentioned image forming method are as follows:

1) The image forming method wherein the formation of the image of the ink material on the image receiving sheet is done by ablation of the image from the support of the heat sensitive ink sheet.

2) The image forming method further contains the steps of:

superposing the image receiving sheet on a white paper sheet in such a manner that the image of the ink material is in contact with a surface of the white paper sheet; and separating the image receiving sheet from the white paper sheet, keeping the image of the ink material on the white paper sheet (it is preferred that said image of the ink material on the white paper sheet has an optical reflection density of at least 1.0).

3) The image forming method wherein the support sheet of the image receiving sheet is made of at least one material selected from the group consisting of polyester, polyamide, polycarbonate, polyethersulfone, polyimide, polyolefin, polyvinyl chloride, polyurethane, polyvinylidene chloride, polyacrylate and cellulose acetate.

4) The image forming method the support sheet of the image receiving sheet has a thickness of 50 to 300 μm (preferably 75 to 200 μm).

5) The image forming method wherein the support sheet of the image receiving sheet is a porous sheet which is sandwiched between a backing layer and an anti-curling layer, the image receiving layer being not provided on the backing layer, and the image receiving layer being provided on the curling layer.

6) The image forming method wherein the heat sensitive ink layer of the heat sensitive ink sheet has a thickness of 0.2 to 1.0 μm.

7) The image forming method wherein the image receiving layer of the image receiving sheet comprises at least two layers (preferably comprises a first image receiving layer and a second image receiving layer).

8) The image forming method wherein said heat sensitive ink layer of the heat sensitive ink sheet is formed of a heat sensitive ink material comprising 30 to 70 weight % of colored pigment and 30 to 70 weight % of thermoplastic resin.

9) The image forming method wherein said thermoplastic resin is amorphous organic polymer having a softening point of 40° to 150° C.

10) The image forming method wherein the heat sensitive ink sheet further has a light-heat conversion layer between the base sheet and the heat sensitive ink layer.

11) The image forming method wherein in the step of superposing a heat sensitive ink sheet having a heat sensitive ink layer on an image receiving sheet, the superposing is conducted in the application of pressure of 1 to 30 kg/cm$^2$ (preferably 2 to 10 kg/cm$^2$)

12) The image forming method wherein the image receiving layer of the image receiving sheet comprises a first receiving layer and a second receiving layer thereon, the first receiving layer comprising at least one resin selected from the group consisting of polyvinyl chloride, vinyl chloride/vinyl acetate copolymer, vinyl chloride/vinyl alcohol copolymer and vinyl chloride/vinyl acetate/maleic acid copolymer.

13) The image forming method wherein the image receiving layer of the image receiving sheet comprises a first receiving layer and a second receiving layer thereon, the second receiving layer comprising at least one resin selected from the group consisting of polyvinyl butyral and alkyl acrylate/acryl amide copolymer.

14) The image forming method wherein the image receiving layer of the image receiving sheet comprises a first receiving layer and a second receiving layer thereon, the first receiving layer having a thickness of 1 to 50 μm (preferably 5 to 30 μm) and the second receiving layer having a thickness of 0.1 to 10 μm (preferably 0.5 to 5 μm).

The method of the invention can be utilized advantageously in preparation of a color proof of full color type.

In more detail, the preparation of a color proof can be performed by the steps of:

superposing a first heat sensitive ink sheet (such as a cyan ink sheet) on an image receiving sheet;

placing imagewise a thermal head on the back (base sheet) of the first heat sensitive ink sheet to form and transfer a color image (cyan image) of the heat sensitive ink material onto the image receiving sheet;

separating the ink sheet from the image receiving sheet so that the color image (cyan image) of the heat sensitive ink material is retained on the image receiving sheet;

superposing a second heat sensitive ink sheet (such as a magenta ink sheet) on the image receiving sheet having the cyan image thereon;

placing imagewise a thermal head on the back of the second heat sensitive ink sheet to form and transfer a color image (magenta image) of the heat sensitive ink material onto the image receiving sheet;

separating the ink sheet from the image receiving sheet so that the color image (magenta image) of the heat sensitive ink material is retained on the image receiving sheet;

superposing a third heat sensitive ink sheet (such as a yellow ink sheet) on the image receiving sheet having the cyan image and magenta image thereon;

placing imagewise a thermal head on the back of the second heat sensitive ink sheet to form and transfer a color image (yellow image) of the heat sensitive ink material onto the image receiving sheet;

separating the ink sheet from the image receiving sheet so that the color image (yellow image) of the heat sensitive ink material is retained on the image receiving sheet, whereby a multicolor image is formed on the image receiving sheet; and transferring thus prepared multicolor image onto a white paper sheet.

The image forming method of the invention employing the above heat sensitive ink sheet and image receiving sheet, which uses a thermal head or laser beam, is capable of giving an image which has dots having preferable size and shape and good reproduction of gradation and which is well analogous to a printed image. In more detail, the use of the plastic sheet having fine pores as the support sheet of the image receiving sheet gives cushion property or flexibility to the image receiving sheet, and therefore pressure given by the thermal head in the transfer procedure or by superposing brings about high and even adhesion between the ink layer and the image receiving layer, which results in reduction of image defects. Further, the use of the plastic sheet scarcely brings about occurrence of trouble during running of the sheet in a thermal transfer printer because the sheet is reduced in weight. Furthermore, the soft sheet almost absorbs the deformation to be formed by incorporation of dust between the sheets in the procedure to reduce defects of the resultant image.

Moreover, in an image forming method using a laser beam, high sensibility can be obtained because the image receiving sheet has low heat conductivity due to fine pores.

In each figure, the axis of abscissas indicates particle size (μm), the left axis of ordinates indicates percentage (%) of particles of the indicated particle sizes, and the right axis of ordinates indicates accumulated percentage (%).

Figure 4:
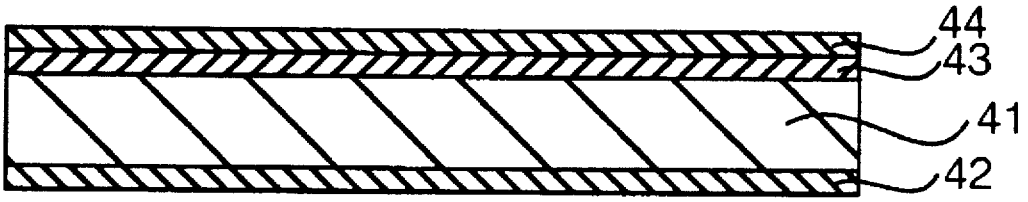

FIG. 4 shows a sectional view of a representative structure of the image receiving sheet of the invention.

Figure 5:
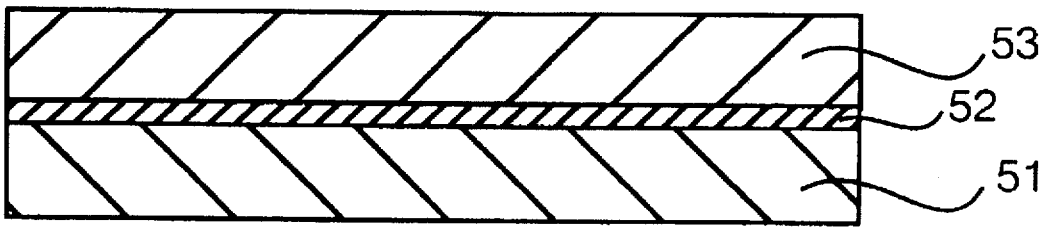

FIG. 5 shows a sectional view of a representative structure of the composite of the invention.

DETAILED DESCRIPTION OF THE INVENTION

The image forming method of the invention is utilized for thermal transfer recording by area gradation using a thermal head or laser beam. The image forming method of the invention is characterized in the use of a porous sheet made of plastics which have fine pores therein as the support sheet of the image receiving sheet. The heat sensitive ink layer of the heat sensitive ink sheet is formed of a heat sensitive ink material which comprises colored pigment and thermoplastic resin such as amorphous organic polymer.

The image receiving sheet employed in the image forming method of the invention comprises a support sheet (plastic support) and an image receiving layer (heat adhesive layer) thereon.

The support sheet of the invention comprises a plastic sheet having fine pores therein as mentioned above. Although the size of the pores is not restricted, the pores are preferably present evenly throughout the whole area of the support. Such a sheet can be, for example, prepared by a known process comprising the steps of adding inorganic or organic particles to a thermoplastic resin and stretching the resin to form apertures (pores) around the particles; the steps of extruding an organic solvent solution of a polymer from an orifice and dipping the polymer solution in a solidifying medium to remove the solvent, whereby apertures (pores) produced by removal of the solvent are formed; or the steps of extruding a resin together with a blowing agent from an orifice, and forming pores.

Examples of plastic materials of the support sheet include polyesters such as polyethylene terephthalate (PET) and polyethylene naphthalate; polyamide; polycarbonate; polyethersulfone; polyimide; polyolefins such as polyethylene and polypropylene; polyvinyl chloride; polyurethane; polyvinylidene chloride; polyacrylates such as PMMA (polymethyl methacrylate) and cellulose acetates such as cellulose triacetate. Preferred are a polyethylene terephthalate and polypropylene. Especially, polyethylene terephthalate is preferred from the viewpoint of dimensional stability. In the case of the image forming method using a thermal head, the thickness of the support generally is in the range of 50 to 250 μm, and preferably in the range of 75 to 150 μm. In the case of the image forming method using a laser beam, the thickness of the support generally is in the range of 50 to 300 μm, and preferably in the range of 75 to 200 μm.

The support sheet preferably is a porous sheet which is sandwiched between a backing layer and an anti-curling layer. The image receiving layer is not provided on the backing layer, but provided on the anti-curling layer. The structure of the image receiving sheet comprising the above support sheet and the image receiving layer (mentioned later) is shown in FIG. 4.

In FIG. 4, the support sheet is composed of a porous plastic sheet 41 and the backing layer 42 on the back and the anti-curling layer 43 on the other side, and the image receiving layer 44 is provided on the anti-curling layer 43. The backing layer functions as lubricating layer to improve running property in a printer. The anti-curling layer is generally provided to prevent curling of the sheet produced by the provision of the backing layer.

The backing layer comprises a binder resin and fine particles, and further may contain additives if desired. Examples of the resin include polyester such as polyethylene terephthalate (PET) and polyethylene naphthalate; polyamide; polycarbonate; polyethersulfone; polyimide; polyolefins such as polyethylene and polypropylene; polyvinyl chloride; polyurethane; pollvinylidene chloride; polyacrylates such as PMMA (polymethyl methacrylate); and cellulose acetates such as cellulose triacetate. Polyesters are preferred from the viewpoint of adhesion.

Examples of the particles include inorganic particles such as barium sulfate, aluminium hydroxide, titanium dioxide, synthetic silica (amorphous), magnesium carbonate, calcium carbonate, calcium silicate, aluminium silicate and magnesium silicate; and organic particles such as particles of carbon fluoride and polytetrafluoroethylene. Preferred are calcium carbonate and titanium dioxide from the viewpoint of cost. The mean particle size preferably is in the range of 0.1 to 10 μm, especially 0.3 to 3 μm from the viewpoint of dispersibility, matte effect and lubricating property.

The anti-curling layer generally comprises materials similar to those of the backing layer, preferably the same materials as those of the backing layer.

These layers may contain an antistatic agent or a surface-active agent. Further, on these layers, an antistatic layer may be provided.

The backing layer and anti-curling layer generally have a thickness of 0.5 to 30 μm.

The support sheet having the backing layer and anti-curling layer can be prepared, for example, by the known method comprising coating liquids for forming the backing layer and the anti-curling layer on the support sheet having fine pores; or laminating the films of the backing layer and the anti-curling layer on the support sheet having fine pores. Further, the support sheet can be prepared by extruding a resin for the support sheet under heating and then monoaxially stretching the resin, subsequently superposing the extruded resins for the backing layer and ant-curling layer on the stretched resin, and then stretching the composite in a direction perpendicular to the monoaxially stretched direction. This extruded method is preferred from the viewpoint of productivity. The support sheet having the backing layer and anti-curling layer prepared by the extruded method, is available as a commercial polyester film (e.g., Lumirror E60, E60L and E68L available from Toray Industries, Inc.; W900E available from Diawhiel Co., Ltd.; Crysper G1212 available from Toyobo Co., Ltd.). Lumirror E60L and Lumirror E68L have the following physical properties:

density=0.8–0.9 g/cm$^3$, surface roughness(SRa)=approx.0.1 μm, and smoothing degree (Beck)=approx. 13,000 sec.

The backing layer and anti-curling layer may have pores therein. The pores can be produced by dispersing the particles in the resin.

A surface of the support sheet (or the anti-curling layer) on which the image receiving layer is formed may be subjected to a coating treatment, or surface treatment such as corona discharge treatment or glow discharge treatment to enhance adhesion. Further an undercoat layer may be formed on the surface of the support. The undercoat layer is not restricted so long as it increases adhesion between the support and the image receiving layer. Preferred material for the undercoat layer is silane coupling agent. Furthermore, the surface of the support may be subjected to antistatic treatment or matting treatment.

The image receiving layer provided on the support sheet may comprise a single layer or two or more layers. The image receiving layer generally comprises a first image receiving layer provided on the support and a second image receiving layer provided on the first image receiving layer.

The first image receiving layer generally has Young's modulus of not more than 200 kg·f/cm$^2$ at room temperature. Use of polymer having low Young's modulus gives cushioning characteristics to the image receiving layer, whereby transferring property is improved to give high recording sensibility, good quality of dot and satisfactory reproducibility of gradation. Further, even if dust or dirt is present between the heat sensitive ink sheet and the image receiving sheet which are superposed for recording, the recorded image (transferred image) hardly has defect due to the cushioning characteristics of the first image receiving sheet. Furthermore, when the image transferred onto the image receiving sheet is retransferred onto a white paper sheet for printing by applying pressure and heat, the retransferring is conducted while the first image receiving layer cushions variation of pressure depending upon unevenness of a surface of the paper sheet. Therefore, the image retransferred shows high bonding strength to the white paper sheet, and further an image (having the second receiving layer thereon) obtained by transferring an image which is formed on the second receiving layer (described later) provided on the first receiving layer together with the second receiving layer onto a white paper, shows a surface of a high gloss to give an image which is well analogous to a printed image.

Examples of polymer materials employed in the first image receiving layer include polyolefins such as polyethylene and polypropylene; copolymers of ethylene and other monomer such as vinyl acetate or acrylic acid ester; polyvinyl chloride; copolymers of vinyl chloride and other monomer such as vinyl acetate, vinyl alcohol or maleic acid; polyvinylidene chloride; copolymer containing vinylidene chloride; polyacrylate; polymethacrylate; polyamides such as copolymerized nylon and N-alkoxymethylated nylon; synthetic rubber; acrylic rubber; and chlorinated rubber. Preferred are polyvinyl chloride, copolymer of vinyl chloride and vinyl acetate, copolymer of vinyl chloride and vinyl alcohol and copolymer of vinyl chloride, vinyl acetate and maleic acid. The degree of polymerization preferably is in the range of 200 to 2,000.

The preferred polymer and copolymer are suitable for material of the first image receiving layer due to the following reason:

(1) The polymer and copolymer show no tackiness at room temperature. (2) The polymer and copolymer have low Young's modulus (modulus of elasticity) and therefore are capable of easily following up unevenesss of a transfer image in the heat transfer procedure. (3) Young's modulus can be easily controlled because the polymer and copolymer have a number of plasticizers showing good compatibility. (4) Bonding strength to other layer or film can be easily controlled because the polymer and copolymer have a polar group such as hydroxyl or carboxyl.

Polymer materials employed in the first image receiving layer may further contain a plasticizer to supplement cushion characteristics. Example of the plasticizer include phthalic acid esters (e.g., dibutyl phthalate, dioctyl phthalate and butyl benzyl phthalate); aliphatic dibasic acid esters (e.g., di(2-ethylhexyl) adipate and di(2-ethylhexyl) sebacate); phosphoric acid triesters (e.g., tricresyl phosphate); polyol acid esters (e.g., polyethylene glycol acid ester); epoxy compounds (e.g., epoxy fatty acid ester); and (meth)acrylic acid esters (e.g., polyethylene glycol dimethacrylate and pentaerythritol triacrytate).

Further, the first receiving layer may contain other various polymer, surface-active agent, surface lubricant or agent for improving adhesion, in order to control bonding strength between the first receiving sheet and the support or the second image receiving layer. Furthermore, the first image receiving layer preferably contain a tacky polymer (tackifier) in a small amount to reduce Young's modulus, so long as the layer has no tackiness.

For example, addition of fluorine-containing surface-active agent give improvement of dot shape by improving wetting property between the ink layer and the image receiving layer as well as reduction of the bonding strength between the layers. However, the excess addition reduces the bonding strength between the ink layer and the image receiving layer to give poor dot shape. Thus the surface-active agent or surface lubricant (e.g., fluorine-containing surface-active agent as above) is preferably added to the polymer material in an amount of 0.0001 to 5 weight %, especially in an amount of 0.001 to 3 weight %.

In the case that polyvinyl chloride or copolymer containing vinyl chloride unit is employed, an organic tin-type stabilizer such as or is preferably incorporated into the polymer or copolymer.

A thickness of the first image receiving layer preferably is in the range of 1 to 50 μm, especially 5 to 30 μm. The thickness is determined by the following reasons: 1) the thickness should be larger than a depth of evenness of surface of the white paper sheet, 2) the thickness should be that capable of absorbing a thickness of the overlapped portion of a number of color images, 3) the thickness should be that capable of absorbing dust stuck onto the image receiving layer or the ink layer in the procedure of superposing the heat sensitive ink sheet and image receiving sheet, and 4) the thickness should have sufficient cushioning characteristics.

The image of the heat sensitive material which has been transferred on the second image receiving layer of the image receiving sheet having the first and second image receiving layers, is further retransferred onto the white paper sheet. In the procedure, the second image receiving layer is transferred on the white paper sheet together with the image. Hence, a surface of the image on the white paper sheet has a gloss analogous to that of a printed image with subjecting to no surface treatment such as matting treatment, due to the second image receiving layer provided on the image. Further, the second image receiving layer improves scratch resistance of the retransferred image.

The second image receiving layer preferably comprises a polymer although the layer can be made of various materials. Examples of these polymers include polyolefins such as polyethylene and polypropylene; copolymers of ethylene and other monomer such as vinyl acetate or acrylic acid ester; polyvinyl chloride; copolymers of vinyl chloride and other monomer such vinyl acetate, vinyl alcohol or maleic acid; copolymer containing vinylidene chloride; polystyrene; copolymer of styrene and other monomer such as maleic acid ester; polyvinyl acetate; butyral resin; modified polyvinyl alcohol; copolymer of alkyl acrylate and acrylamide; polyamides such as copolymerized nylon and N-alkoxymethylated nylon; synthetic rubber; chlorinated rubber; phenol resin; epoxy resin; urethane resin; urea resin; melamine resin; alkyd resin; maleic acid resin; copolymer containing hydroxystyrene; sulfonamide resin; rosin ester; celluloses; and rosin. Preferred are butyral resin and copolymer of alkyl acrylate and acrylamide.

The second image receiving layer can contain a surface-active agent, surface lubricant, plasticizer or agent for improving adhesion in order to control bonding strength between the second image receiving layer and the first image receiving layer or the heat sensitive ink layer. Further, it is preferred to employ a solvent not to dissolve or swell the resin contained in the first image receiving layer as a solvent used in a coating liquid for forming the second image receiving layer. For example, when polyvinyl chloride, which easily dissolves in various solvents, is used as a resin of the first image receiving layer, a solvent used in the coating liquid of the second image receiving layer preferably is alcohols or solvents mainly containing water.

A thickness of the second receiving layer preferably is in the range of 0.1 to 10 μm, especially 0.5 to 5.0 μm. The thickness exceeding 10 μm damages unevenness of the transferred image derived from an uneven surface of the white paper sheet (onto which the image on the image receiving sheet is retransferred) and therefore the transferred image is not near to a printed image due to its high gloss.

In order to control the bonding strength between the first and second image receiving layers, solvents contained in the coating solution of the first and second image receiving layers are selected as mentioned above; further for example, the materials of the first and second image receiving layers are used in combination of hydrophilic polymer and liophilic polymer, in combination of polar polymer and nonpolar polymer, or as the additives such as surface-active agent, surface lubricant such as a fluorine-containing compound or silicone-containing compound, plasticizer or agent for improving adhesion such as silane coupling agent are appropriately used.

On the second image receiving layer, a lubricating layer (overcoating layer) can be provided to improve lubricating property and scratch resistance of a surface of the second image receiving layer.

Examples of materials forming the layer include a higher fatty acid (e.g., palmitic acid or stearic acid), a metal salt of a fatty acid (e.g., zinc stearate), a fatty acid derivative (e.g., fatty acid ester, its partial saponification product or fatty acid amide), a higher alcohol, a polyol derivative (e.g., ester of polyol), wax (e.g., paraffin wax, carnauba wax, montan wax, bees wax, Japan wax, or candelilla wax), cationic surfactant (e.g., ammonium salt having long aliphatic chain group or pyridinium salt), anionic and nonionic surfactants having a long aliphatic chain group, and perfluoro-type surfactant.

An intermediate layer can be provided between the first and second image receiving layers, in order to control transferring property.

The above explanation of the image receiving sheet corresponds to the case that cushion property is given to the first image receiving layer of the image receiving sheet. Alternatively, both of cushion property and function for forming an image can be given to the second image receiving layer of the image receiving sheet. In this case, the first image receiving sheet functions as a peeling layer. In also such image receiving layers, the same materials as mentioned previously can be employed.

The above structure of the image receiving sheet is especially useful in the image forming method using a laser beam.

The image receiving layer may consist of a single layer. As the single layer, the above second image receiving layer can be employed. The single layer preferably has a thickness of 0.2 to 50 μm, especially 0.5 to 20 μm.

The heat sensitive ink sheet has a base sheet and a heat sensitive ink layer which is formed of a heat sensitive ink material comprising colored pigment and thermoplastic resin. The sheet having such an ink layer can be employed in the image forming method using a laser beam.

In the image forming method using a thermal head, the heat sensitive ink sheet has a base sheet and a heat sensitive ink layer having a thickness of 0.2 to 1.0 μm which is formed of a heat sensitive ink material comprising 30 to 70 weight % of colored pigment and 25 to 65 weight % of amorphous organic polymer having a softening point of 40° to 150° C. The sheet also corresponds to the preferred embodiment in the image forming method using a laser beam.

The heat sensitive ink sheet can be particularly utilized in the formation of multigradation image (especially multicolor image) by area gradation (multi-valued recording), while the sheet can be naturally utilized in binary recording.

As the base sheet, any of the materials of the support sheet employed in the conventional fused ink transfer system and sublimation ink transfer system can be employed. Preferably employed is a polyester film of approx. 5 μm thick which has been subjected to release treatment.

In the image forming method using a laser beam, the base sheet is generally made of materials through which light passes. Examples of the materials include polyethylene terephthalate (PET), polycarbonate, polyethylene, polyvinyl chloride, pollvinylidene chloride, polystyrene and styrene/acrylonitrile copolymer. Preferred are a polyethylene terephthalate and polypropylene. Especially, biaxially oriented polyethylene terephthalate is preferred from the viewpoint of mechanical strength and dimensional stability. The surface of the base sheet may be subjected to glow discharge or corona discharge treatment. The thickness of the base sheet generally is in the range of 10 to 200 μm, and preferably in the range of 20 to 150 μm. Further, a undercoat layer may be formed on the surface of the base sheet, if desired. The undercoat layer are preferably formed of materials showing good adhesion and excellent heat resistance. Preferred is polystyrene having small heat conductivity in order to depress reduction of the sensitivity caused by heat conductive. The thickness of the undercoat layer is generally in the range of 0.01 to 2 μm.

The colored pigment to be incorporated into the heat sensitive ink layer of the invention can be optionally selected from known pigments. Examples of the known pigments include carbon black, azo-type pigment, phthalocyanine-type pigment, qunacridone-type pigment, thioindigo-type pigment, anthraquinone-type pigment, and isoindolin-type pigment. These pigments can be employed in combination with each other. A known dye can be employed in combination with the pigment for controlling hue of the color image.

The heat transfer ink layer of the invention contains the pigment in an amount of 30 to 70 weight % and preferably in an amount of 30 to 50 weight %. When the amount of the pigment is not less than 30 weight %, it is difficult to form an ink layer of the thickness of 0.2 to 1.0 μm which shows a high reflection density. Moreover, the pigment preferably has such particle distribution that at least 70 weight % of the pigment particles has a particle size of not less than 1.0 μm. A pigment particle of large particle size reduces transparency of the formed image, particularly in the area in which a number of color images are overlapped. Further, large particles bring about difficulty to prepare the desired ink layer satisfying the relationship between the preferred thickness and reflection density.

Any of amorphous organic polymers having a softening point of 40° to 150° C. can be employed for the preparation of the ink layer of the heat sensitive ink sheet of the invention. A heat-sensitive ink layer using an amorphous organic polymer having a softening point of lower than 40° C. shows unfavorable adhesion, and a heat-sensitive ink layer using an amorphous organic polymer having a softening point of higher than 150° C. shows poor sensitivity. Examples of the amorphous organic polymers include butyral resin, polyamide resin, polyethyleneimine resin, sulfonamide resin, polyester-polyol resin, petroleum resin, homopolymers and copolymers of styrene or its derivatives (e.g., styrene, vinyltoluene, α-methylstyrene, 2-methylstyrene, chlorostyrene, vinylbenzoic acid, sodium vinylbenzenesulfonate and aminostyrene), and homopolymers and copolymers of methacrylic acid or its ester (e.g., methacrylic acid, methyl methacrylate, ethyl methacrylate, butyl methacrylate, and hydroxyethyl methacrylate), homopolymers and copolymers of acrylic acid or its ester (e.g., acrylic acid, methyl acrylate, ethyl acrylate, butyl acrylate, and α-ethylhydroxy acrylate), homopolymers and copolymers of a diene compound (e.g., butadiene and isoprene), and homopolymers and copolymers of other vinyl monomers (e.g., acrylonitrile, vinyl ether, maleic acid, maleic acid ester, maleic anhydride, cinnamic acid, vinyl chloride, and vinyl acetate). Further, there can be mentioned copolymers of at least two monomers selected from acrylic acid, its ester, methacrylic acid, its ester, a diene compound and other vinyl monomers, which are described above. These resins and polymers can be employed in combination.

Particularly preferred are butyral resin and styrene/maleic acid half ester resin, from the viewpoint of good dispersibility of the pigment.

Examples of trade names of the butyral resin include Denka butyral #2000-L (softening point: 57° C. (measured by DSC (Differential Scanning Calorimeter); degree of polymerization: approx. 300) and Denka butyral #4000-1 (softening point: 57° C.; degree of polymerization: approx. 920) which are available from Denki Kagaku Kogyo Co., Ltd.; and Eslec BX-10 (softening point: 72° C.; Tg: 74° C.; degree of polymerization: 80; acetyl value: 69 molar %) and Eslec BL-S (Tg: 61° C., viscosity: 12 cps in 5 weight % ethanol/toluene [1/1 by weight] solution) which are available from Sekisui Chemical Co., Ltd.

In the heat sensitive ink sheet of the invention, the ink layer contains the amorphous organic polymer having a softening point of 40° to 150° C. in an amount of 25 to 65 weight % (30 to 70 weight % in the method using laser beam), and preferably in an amount of 30 to 50 weight %.

In the invention, it is preferred that both of the heat sensitive ink layer and the second image receiving layer contain the same polymer or the same kind polymer each other.

The heat sensitive ink layer preferably contains a nitrogen-containing compound. The nitrogen-containing compound preferably is an amide compound having the formula (I) described above, an amine compound, a quaternary ammonium salt having the formula (II) or formula (III) described above, hydarazine, aromatic amine or a heterocyclic compound. Preferred is an amide compound having the formula (I).

The amide compound having the formula (I) is explained.

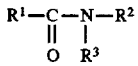

(I)

in which $R^1$ represents an alkyl group of 8 to 24 carbon atoms, an alkoxyalkyl group of 8 to 24 carbon atoms, an alkyl group of 8 to 24 carbon atoms having a hydroxyl group, or an alkoxyalkyl group of 8 to 24 carbon atoms having a hydroxyl group, and each of $R^2$ and $R^3$ independently represents a hydrogen atom, an alkyl group of 1 to 12 carbon atoms, an alkoxyalkyl of 1 to 12 carbon atoms, an alkyl group of 1 to 12 carbon atoms having a hydroxyl group, or an alkoxyalkyl group of 1 to 12 carbon atoms having a hydroxyl group, provided that $R^1$ is not the alkyl group in the case that $R^2$ and $R^3$ both represent a hydrogen atom.

In the formula (I), $R^1$ generally is an alkyl group of 8 to 18 carbon atoms, an alkoxyalkyl group of 8 to 18 carbon atoms, an alkyl group of 8 to 18 carbon atoms having a hydroxyl group, or an alkoxyalkyl group of 8 to 18 carbon atoms having a hydroxyl group. $R^1$ preferably is an alkyl group of 8 to 18 carbon atoms (especially 12 to 18 carbon atoms) or an alkyl group of 8 to 18 carbon atoms (especially 12 to 18 carbon atoms) having a hydroxyl group.

$R^2$ generally represents a hydrogen atom, an alkyl group of 1 to 10 carbon atoms (especially 1 to 8 carbon atoms), an alkoxyalkyl group of 1 to 10 carbon atoms (especially 1 to 8 carbon atoms), an alkyl group of 1 to 10 carbon atoms having a hydroxyl group (especially 1 to 8 carbon atoms), or an alkoxyalkyl group of 1 to 10 carbon atoms having a hydroxyl group (especially 1 to 8 carbon atoms). $R^2$ preferably is an alkyl group of 1 to 10 carbon atom (especially 1 to 8 carbon atoms) or an alkyl group of 1 to 10 carbon atom (especially 1 to 8 carbon atoms) having a hydroxyl group.

$R^3$ preferably is a hydrogen atom, an alkyl group of 1 to 4 carbon atom (especially 1 to 3 carbon atoms). Especially, $R^3$ preferably is a hydrogen atom. Examples of the alkyl groups include methyl, ethyl, isopropyl, n-propyl, n-butyl, isobutyl and tert-butyl.

However, $R^1$ is not the alkyl group (i.e., $R^1$ is the alkoxyalkyl, the alkyl group having a hydroxyl group or the alkoxyalkyl having a hydroxyl group), in the case that $R^2$ and $R^3$ both represent a hydrogen atom.

The amide of the formula (I) can be prepared by reacting an acyl halide with amine (by adding acyl halide to an aqueous alkaline solution containing the amine) to introduce the acyl group into the amine, which is performed, for example, according to Schotten-Baumann method. In more detail, acyl halide is dropwise added to a chilled alkaline solution containing amine, and operations such as addition and mixing are conducted so as to maintain the reaction temperature of not higher than 15° C. In the reaction, use of amine, alkali and acyl halide in a ratio of 1:1:1 gives an amide compound.

In the case that amine which is sparingly soluble in water is used, an ether solution containing tertiary amine is employed instead of the aqueous alkaline solution. In more detail, an acyl halide is dropwise added to an ether solution containing amine and triethylamine. In the reaction, use of amine, triethylamine and an acyl halide in the ratio of 1:1:1 gives an amide compound. The obtained amide compound can be purified by recrystallization if desired, to give a pure amide compound.

The amide compound of the formula (I) can be, for example, prepared by using an acyl halide and amine in the combinations set forth in Table 1.

TABLE 1

| Acyl Halide | Amine |
|---|---|
| $CH_3(CH_2)_5CH(OH)(CH_2)_{10}COCl$ | $H_2NC_2H_4OH$ |
| $CH_3(CH_2)_5CH(OH)(CH_2)_{10}COCl$ | $NH_3$ |
| n-$C_9H_{19}COCl$ | $CH_3NH_2$ |
| n-$C_{15}H_{31}COCl$ | $CH_3NH_2$ |
| n-$C_{17}H_{35}COCl$ | $CH_3NH_2$ |
| n-$C_{17}H_{35}COCl$ | n-$C_4H_9NH_2$ |
| n-$C_{17}H_{35}COCl$ | n-$C_6H_{13}NH_2$ |
| n-$C_{17}H_{35}COCl$ | n-$C_8H_{17}NH_2$ |
| n-$C_{17}H_{35}COCl$ | $H_2NC_2H_4OC_2H_4OH$ |
| n-$C_{17}H_{35}COCl$ | $(CH_3)_2NH$ |
| n-$C_{17}H_{35}COCl$ | $(C_2H_5)_2NH$ |

Examples of the obtained amide compounds are shown in Table 2. The compounds are indicated by $R^1$, $R^2$ and $R^3$ of the formula (I).

TABLE 2

| $R^1$ | $R^2$ | $R^3$ |
|---|---|---|
| $CH_3(CH_2)_5CH(OH)(CH_2)_{10}$ | $C_2H_4OH$ | H |
| $CH_3(CH_2)_5CH(OH)(CH_2)_{10}$ | H | H |
| n-$C_9H_{19}$ | $CH_3$ | H |
| n-$C_{15}H_{31}$ | $CH_3$ | H |
| n-$C_{17}H_{35}$ | $CH_3$ | H |
| n-$C_{17}H_{35}$ | $C_2H_5$ | H |
| n-$C_{17}H_{35}$ | n-$C_4H_9$ | H |
| n-$C_{17}H_{35}$ | n-$C_6H_{13}$ | H |
| n-$C_{17}H_{35}$ | n-$C_8H_{17}$ | H |
| n-$C_{17}H_{35}$ | $C_2H_4OC_2H_4OH$ | H |
| n-$C_{17}H_{35}$ | $CH_3$ | $CH_3$ |
| n-$C_{17}H_{35}$ | $C_2H_5$ | $C_2H_5$ |

Subsequently, the quaternary ammonium salt of the formula (II) described above is explained below.

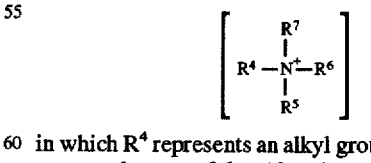

(II)

in which $R^4$ represents an alkyl group of 1 to 18 carbon atom or an aryl group of 6 to 18 carbon atoms, each of $R^5$, $R^6$ and $R^7$ independently represents a hydrogen atom, a hydroxyl group, an alkyl group of 1 to 18 carbon atom or an aryl group of 6 to 18 carbon atoms, and $X_1$ represents a monovalent anion.

In the formula (II), $R^4$ preferably is an alkyl group of 1 to 12 carbon atom (especially 1 to 8 carbon atom) or an aryl group of 6 to 12 carbon atoms (e.g., phenyl or naphthyl). Examples of the alkyl groups include methyl, ethyl, isopropyl, n-propyl, n-butyl, isobutyl, tert-butyl, n-pentyl, n-hexyl and n-octyl. Each of $R^5$, $R^6$ and $R^7$ preferably is an alkyl group of 1 to 12 carbon atom (especially, 1 to 8 carbon atom) or an aryl group of 6 to 12 carbon atoms (e.g., phenyl or naphthyl). $X_1$ preferably is a halide ion, especially $Cl^-$ or $Br^-$.

Examples of the quaternary ammonium salts of the formula (II) include ammonium chloride, tetra-n-butylammonium bromide and triethylmethylammonium chloride.

The quaternary ammonium salt of the formula (III) described above is explained below.

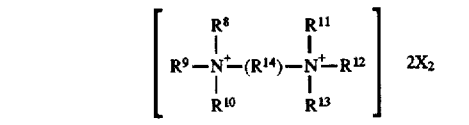

(III)

in which each of $R^8$, $R^9$, $R^{10}$, $R^{11}$, $R^{12}$ and $R^{13}$ independently represents a hydrogen atom, a hydroxyl group, an alkyl group of 1 to 18 carbon atom or an aryl group of 6 to 18 carbon atoms, $R^{14}$ represents an alkylene group of 1 to 12 carbon atom, and $X_2$ represents a monovalent anion.

The quaternary ammonium salt of the formula (III) is a dimmer of the quaternary ammonium salt as described above, and the example includes hexamethonium bromide [i.e., hexamethylenebis(tri-methylammonium bromide)].

Examples of the amines mentioned above include cyclohexylamine, trioctylamine and ethylenediamine.

Examples of the hydrazines include dimethylhydradine.

Examples of the aromatic amines include p-toluidine, N,N-dimethylaniline and N-ethylaniline.

Examples of the heterocyclic compounds include N-methylpyrrole, N-ethylpyridinium bromide, imidazole, N-methylquinolinium bromide and 2-methylbenzothiazole.

The heat sensitive ink layer generally contains 0.1 to 20 weight % of the nitrogen-containing compound, and especially 1 to 10 weight % of the compound. The compound preferably exists in the heat sensitive ink sheet in the amount of 0.001 to 2 g per 1 $m^2$, especially in the amount of 0.01 to 0.5 g per 1 $m^2$.

The ink layer can further contain 1 to 20 weight % of additives such as a releasing agent and/or a softening agent based on the total amount of the ink layer so as to facilitate release of the ink layer from the support when the thermal printing (image forming) takes place and increase heat-sensitivity of the ink layer. Examples of the additives include a higher fatty acid (e.g., palmitic acid and stearic acid), a metal salt of a fatty acid (e.g., zinc stearate), a fatty acid derivative (e.g., fatty acid ester and its partial saponification product), a higher alcohol, a polyol derivative (e.g., ester of polyol), wax (e.g., paraffin wax, carnauba wax, montan wax, bees wax, Japan wax, and candelilla wax), low molecular weight polyolefin (e.g., polyethylene, polypropylene, and polybutyrene) having a viscosity mean molecular weight of approx. 1,000 to 10,000, low molecular weight copolymer of olefin (specifically α-olefin) with an organic acid (e.g., maleic anhydride, acrylic acid, and methacrylic acid) or vinyl acetate, low molecular weight oxidized polyolefin, halogenated polyolefin, homopolymer of acrylate or methacrylate (e.g., methacylate having a long alkyl chain such as lauryl methacrylate and stearyl methacrylate, and acrylate having a perfluoro group), copolymer of acrylate or methacrylate with vinyl monomer (e.g., styrene), low molecular weight silicone resin and silicone modified organic material (e.g., polydimethylsiloxane and polydiphenylsiloxane), cationic surfactant (e.g., ammonium salt having a long aliphatic chain group and pyridinium salt), anionic and nonionic surfactants having a long aliphatic chain group, and perfluoro-type surfactant.

The compounds are employed singly or in combination with two or more kinds.

The pigment can be appropriately dispersed in the amorphous organic polymer by conventional methods known in the art of paint material such as that using a suitable solvent and a ball mill. The nitrogen-containing compound and the additives can be added into the obtained dispersion to prepare a coating liquid. The coating liquid can be coated on the support according to a conventional coating method known in the art of paint material to form the heat-sensitive ink layer.

The thickness of the ink layer is in the range of 0.2 to 1.0 m, and preferably in the range of 0.3 to 0.6 μm (more preferably in the range of 0.3 to 0.5 μm). An excessively thick ink layer having a thickness of more than 1.0 μm gives an image of poor gradation on the shadow portion and highlight portion in the reproduction of image by area gradation. A very thin ink layer having a thickness o less than 0.2 μm cannot form an image of acceptable optical reflection density.

In the method using a laser beam, the thickness of the ink layer is in the range of 0.2 to 1.5 μm, and preferably in the range of 0.2 to 1.0 μm (more preferably in the range of 0.2 to 0.6 μm ). An excessively thick ink layer having a thickness of more than 1.5 μm gives an image of poor gradation on the shadow portion and highlight portion in the reproduction of image by area gradation. A very thin ink layer having a thickness o less than 0.2 μm cannot form an image of acceptable optical reflection density.

The heat-sensitive ink layer of the invention mainly comprises a pigment and an amorphous organic polymer, and the amount of the pigment in the layer is high, as compared with the amount of the pigment in the conventional ink layer using a wax binder. Therefore, the ink layer of the invention shows a viscosity of higher than $10^4$ cps at 150° C. (the highest thermal transfer temperature), while the conventional ink layer shows a viscosity of $10^2$ to $10^3$ cps at the same temperature. Accordingly, when the ink layer of the invention is heated, the ink layer per se is easily peeled from the support and transferred onto an image receiving layer keeping the predetermined reflection density. Such peeling type transfer of the extremely thin ink layer enables to give an image having a high resolution, a wide gradation from a shadow potion to a highlight portion, and satisfactory edge sharpness. Further, the complete transfer (100%) of image onto the image receiving sheet gives desired uniform reflection density even in a small area such as characters of 4 point and a large area such as a solid portion.

The composite of the invention comprises the image receiving sheet comprising the support sheet and the image receiving layer and the heat sensitive ink sheet, which are described above. The composite is advantageously employed in the following image forming methods. The structure of the composite is shown in FIG. 5.

In FIG. 5, the heat sensitive ink sheet 53 is superposed on the image receiving layer 52 of the image receiving sheet comprising the support sheet 51 and the image receiving layer 52 to constitute the composite.

Subsequently, the image forming method of the invention is described below.

The image forming method (thermal transfer recording) of the invention can be, for example, performed by means of a thermal head (generally using as thermal head printer) using the above heat sensitive ink sheet and the above image receiving sheet.

The method utilizing the thermal head can be conducted by the steps of: superposing the heat sensitive ink sheet having the heat sensitive ink layer on the image receiving sheet (formation of composite of the invention); placing imagewise a thermal head the back (the base sheet) of the heat sensitive ink sheet to form and transfer an image of the heat sensitive ink material of the ink layer onto the image receiving sheet (generally the second image receiving layer) by separating the ink sheet from the image receiving sheet. The formation of the image using the thermal head is generally carried out utilizing area gradation. The transferred image onto the image receiving layer has an optical reflection density of at least 1.0.

For conducting the formation of the image, the heat sensitive ink sheet is laminated on the image receiving sheet using a laminator in such a manner that the heat sensitive ink layer is in contact with the image receiving layer to prepare a composite, and this composite can be employed.

Subsequently, the following procedures can be performed. After a white paper sheet is prepared, the image receiving sheet having the transferred image is superposed on the white paper sheet, which generally is a support for printing, in such a manner that the transferred image is in contact with a surface of the white paper sheet, and the composite is subjected to pressing and heating treatments, and the image receiving sheet (having the first image receiving layer) is removed from the composite whereby the retransferred image can be formed on the white paper sheet (together with the second image receiving layer). The transferred image onto the white paper sheet has an optical reflection density of at least 1.0.

The above formation of the image can be generally conducted using the thermal head printer by means of area gradation.

Further, the method similar to the above-mentioned image forming method can be conducted using a laser beam instead of the thermal head. The image forming method (thermal transfer recording method) utilizing the a laser beam can utilize methods (i.e., ablation method) described in U.S. Pat. No. 5,352,562 and Japanese Patent Provisional Publication No. 6(1994)-219052. The method of Japanese Patent Provisional Publication No. 6(1994)-219052 is performed by the steps of: superposing a heat sensitive ink sheet comprising a base sheet and a heat sensitive ink layer (image forming layer) between which a light-heat conversion layer capable of converting an absorbed laser beam into heat energy and a heat sensitive peeling layer containing heat sensitive material capable of producing a gas by absorbing the heat energy (or only a light-heat conversion layer further containing the heat sensitive material) are provided on the image receiving sheet in such a manner that the heat sensitive ink layer is in contact with a surface of the image receiving sheet; irradiating imagewise a laser beam on the composite (the heat sensitive ink sheet and the image receiving sheet) to enhance temperature of the light-heat conversion layer; causing ablation by decomposition or melting of materials of the light-heat conversion layer and decomposing a portion of the heat sensitive peeling layer to produce a gas, whereby bonding strength between the heat sensitive ink layer and the light-heat conversion layer reduces; and transferring the heat sensitive ink layer corresponding to the portion onto the image receiving layer.

The above image forming method is usually conducted using a laser recording machine. First, the side (support sheet) having no image receiving layer of the image receiving sheet is closely placed and fixed on a laser recording drum by the means of suction, etc. (e.g., fixed on the drum by sucking inside of the drum). Then, the ink layer of the heat-sensitive ink sheet is placed on the image receiving layer of the image receiving sheet, passed through a couple of rollers under pressure (if desired under heating), whereby the heat-sensitive ink sheet and the image receiving sheet are united to prepare a composite. The composite can be beforehand prepared with using no laser recording drum by superposing the heat-sensitive ink sheet on the image receiving sheet in such a manner that the ink layer is in contact with the image receiving layer and passing them under pressure (if desired under heating) through a couple of rollers, and the composite can be also employed in the later procedure.

The pressure for preparing the composite is generally in the range of 1 to 30 kg/cm$^2$, preferably in the range of 2 to 10 kg/cm$^2$. The procedure of passing the sheets under pressure through a couple of rollers is preferably conducted under heating. The heating is conducted in such a manner that the surfaces of the rollers are preferably heated at a temperature of not higher than 250° C., especially at a temperature of 60° to 150° C. The support sheet of the image receiving sheet is made of plastic sheet having fine pores therein, and therefore the pressing procedure can be conducted under even pressure due to cushion property and flexibility of the support sheet to form a composite in which the heat sensitive ink sheet is closely superposed on the image receiving sheet. When dust is stuck onto the image receiving layer or the ink layer in the procedure of superposing the heat sensitive ink sheet and image receiving sheet, the support sheet almost cushions deformation by dust to reduce image defect.

Subsequently, a laser beam modulated by color separated image signals scans the heat sensitive ink sheet of the composite on the recording drum with rotating the drum, to record the signals. Then, the heat sensitive ink sheet is peeled from the image receiving sheet to form a transferred image on the image receiving sheet. The resultant image generally has area gradation of an optical reflection density of at least 0.5.

Otherwise, in the above method using a laser beam, formation of the image can be also conducted by the steps of portionwise melting the heat sensitive ink layer by means of heat energy given by absorption of a laser beam, and transferring the portion onto the image receiving sheet under melting.

Further, the resultant transferred image formed on the image receiving sheet is superposed on a white paper sheet (printing paper) which is separately prepared, and the composite is pressed under heating to form a retransferred image on the white paper sheet. The resultant image generally has area gradation of an optical reflection density of at least 1.0.

In the above method using a laser beam (utilizing the ablation), a light-heat conversion layer is preferably provided between tha base sheet and the heat sensitive ink layer. Further, a heat sensitive peeling layer is provided on the light-heat conversion layer in order to advantageously conduct the ablation method. When the light-heat conversion layer combines light-heat conversion function with heat sensitive peeling function, the heat sensitive peeling layer may be not necessarily provided.

The light-heat conversion layer and heat sensitive peeling layer mentioned above are explained below.

The light-heat conversion layer basically comprises a coloring material (e.g., dye or pigment) and a binder.

Examples of the coloring material include black pigments such as carbon black, pigments of large cyclic compounds such as phthalocyanine and naphthalocyanine absorbing a light having wavelength from visual region to infrared region, organic dyes such as cyanine dyes (e.g., indolenine compound), anthraquinone dyes, azulene dyes and phthalocyanine dyes which are employed as laser absorbing materials of high-density laser recording media such as an optical disc, and dyes of organic metal compounds such as dithiol nickel complex. The light-heat conversion layer preferably is as thin as possible to enhance recording sensitivity, and therefore dyes such as cyanine, phthalocyanine and naphthalocyanine having a large absorption coefficient are preferably employed.

Examples of the binder include homopolymer or copolymer of acrylic monomers such as acrylic acid, methacrylic acid, acrylic acid ester and methacrylic acid ester; celluloses such as methyl cellulose, ethyl cellulose and cellulose acetate; vinyl polymers such as polystyrene, vinyl chloride/vinyl acetate copolymer, polyvinyl pyrrolidone, polyvinyl butyral and polyvinyl alcohol; copolymer of vinyl monomers; polycondensation polymers such as polyester and polyamide; and thermoplastic polymers containing rubber (e.g., butadiene/styrene copolymer). Otherwise, the binder may be a resin formed by polymerization or cross-linkage of monomers such as epoxy compounds by means of light or heating.

A ratio between the amount of the coloring material and that of the binder preferably is in the range of 1:5 to 10:1 (coloring material:binder), especially in the range of 1:3 to 3:1. When the amount of the binder is less than the lower limit, cohesive force of the light-heat conversion layer lowers and therefore the layer is apt to transfer onto the image receiving sheet together with the heat sensitive ink layer in the transferring procedure. Further, the light-heat conversion layer containing excess binder needs a large thickness to show a desired light absorption, which occasionally results in reduction of sensitivity.

The thickness of the light-heat conversion layer generally is in the range of 0.05 to 2 μm, and preferably 0.1 to 1 μm. The light-heat conversion layer preferably shows light absorption of not less than 70% in a wavelength of a used laser beam.

The heat sensitive peeling layer is a layer containing a heat sensitive material. Examples of the material include a compound (e.g., polymer or low-molecular weight compound) which is itself decomposed or changed by means of heating to produce a gas; and a compound (e.g., polymer or low-molecular weight compound) in which a relatively volatile liquid such as water has been adsorbed or absorbed in marked amount. These compounds can be employed singly or in combination of two kinds.

Examples of the polymers which are itself decomposed or changed by means of heating to produce a gas include self-oxidizing polymers such as nitrocellulose; polymers containing halogen atom such as chlorinated polyolefin, chlorinated rubber, polyvinyl chloride and polyvinylidene chloride; acrylic polymers such as polyisobutyl methacylate in which relatively volatile liquid such as water has been adsorbed; cellulose esters such as ethyl cellulose in which relatively volatile liquid such as water has been adsorbed; and natural polymers such as gelatin in which relatively volatile liquid such as water has been adsorbed.

Examples of the low-molecular weight compounds which are itself decomposed or changed by means of heating to produce a gas include diazo compounds and azide compounds.

These compounds which are itself decomposed or changed preferably produce a gas at a temperature not higher than 280° C., especially produce a gas at a temperature not higher than 230° C. (preferably a temperature not lower than 100° C.).

In the case that the low-molecular weight compound is employed as the heat sensitive material of the heat sensitive peeling layer, the compound is preferably employed together with the binder. The binder may be the polymer which itself decomposes or is changed to produce a gas or a conventional polymer having no property mentioned above. A ratio between the low-molecular weight compound and the binder preferably is in the range of 0.02:1 to 3:1 by weight, especially 0.05:1 to 2:1.

The heat sensitive peeling layer is preferably formed on the whole surface of the light-heat conversion layer. The thickness preferably is in the range of 0.03 to 1 μm, especially 0.05 to 0.5 μm.

The present invention is further described by the following Examples and Comparison Examples. The term "part (s)" indicated in Example means "weight part(s)".

EXAMPLE 1

(1) Preparation of heat sensitive ink sheet

The following three pigment dispersions were prepared:

| | | |
|---|---|---|
| A) | Cyan pigment dispersion | |
| | Cyan Pigment (CI, P.B. 15:4) | 12.0 parts |
| | Binder solution | 122.8 parts |
| B) | Magenta pigment dispersion | |
| | Magenta Pigment (CI, P.R. 57:1) | 12.0 parts |
| | Binder solution | 122.8 parts |
| C) | Yellow pigment dispersion | |
| | Yellow Pigment (CI, P.Y. 14) | 12.0 parts |
| | Binder solution | 122.8 parts |

The binder solution comprised the following components:

| | |
|---|---|
| Butyral resin (softening point: 57° C., Denka Butyral #2000-L, available from Denki Kagaku Kogyo K.K.) | 12.0 parts |
| Solvent (n-propyl alcohol) | 110.0 parts |
| Dispersing agent (Solsparese S-20000, available from ICI Japan Co., Ltd.) | 0.8 parts |

Figure 1:
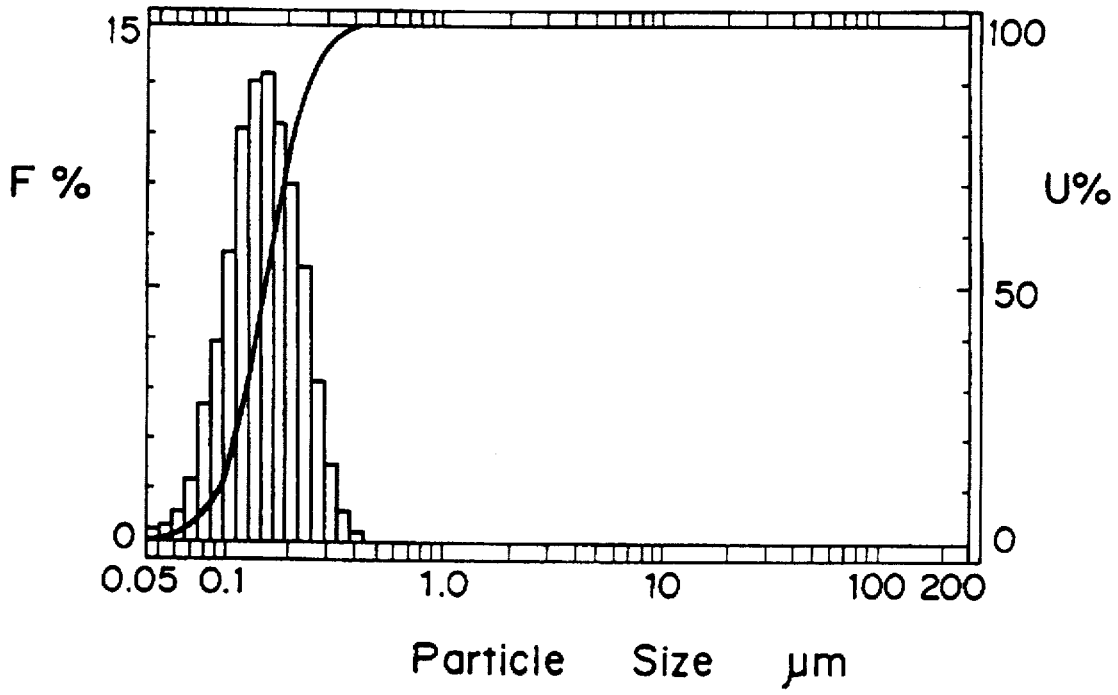
FIG. 1 shows a particle size distribution of cyan pigment employed in Example 1.
Figure 2:
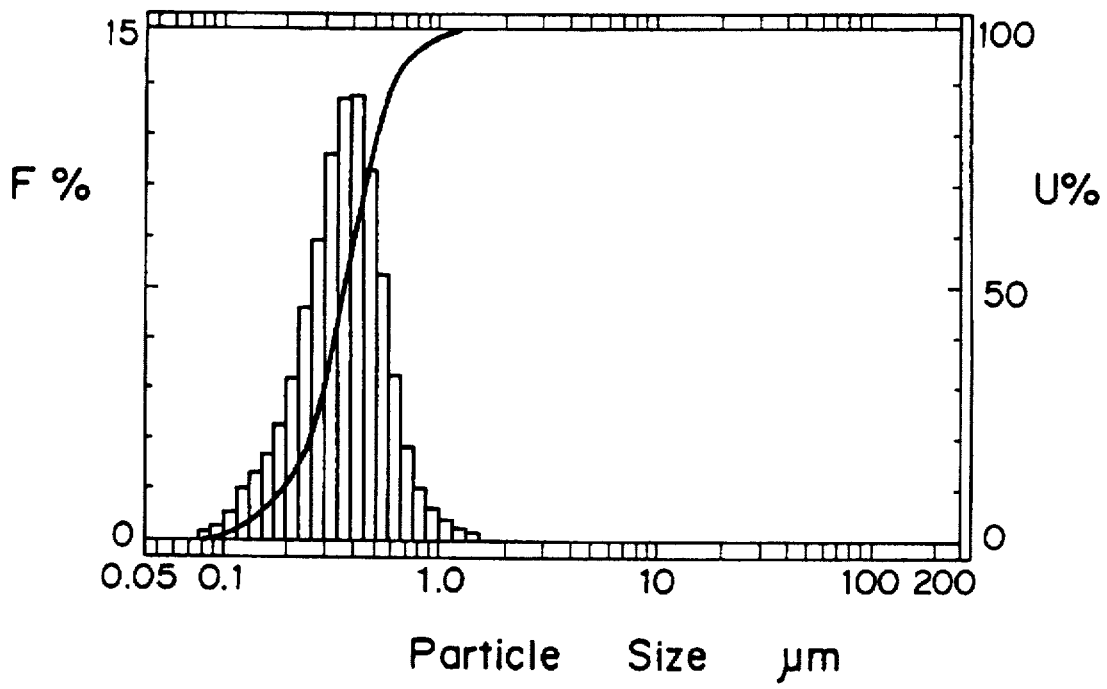
FIG. 2 shows a particle size distribution of magenta pigment employed in Example 1.
Figure 3:
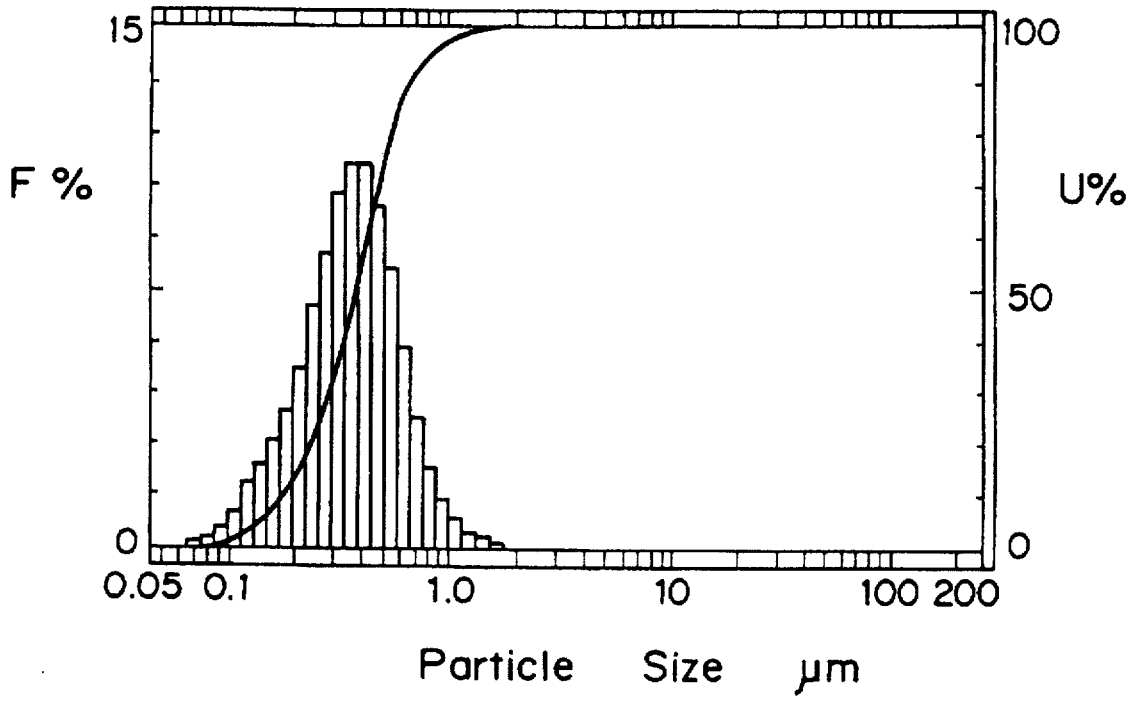
FIG. 3 shows a particle size distribution of yellow pigment employed in Example 1.

The particle size distribution of the pigments in the dispersions are shown in the attached figures, wherein FIG. 1 indicates the distribution of cyan pigment; FIG. 2 indicates the distribution of magenta pigment; and FIG. 3 indicates the distribution of yellow pigment. In each figure, the axis of abscissas indicates particle size (μm), the left axis of ordinates indicates percentage (%) of particles of the indicated particle sizes, and the right axis of ordinates indicates accumulated percentage (%).

in FIG. 1, a median size of the particles is 0.154 μm, the specific surface is 422.354 $cm^2/cm^3$, and 90% of the total particles have particle sizes of not less than 0.252 μm. in FIG. 2, a median size of the particles is 0.365 μm, the specific surface is 189.370 $cm^2/cm^3$, and 90% of the total particles have particle sizes of not less than 0.599 μm. In FIG. 3, a median size of the particles is 0.364 μm, the specific surface is 193.350 $cm^2/cm^3$, and 90% of the total particles have particle sizes of not less than 0.655 μm.

To 10 parts of each pigment dispersion were added 0.24 part of N-hydroxyethyl-12-hydoxystearic amide, 0.01 part of a surface active agent (Megafack F-177, available from Dainippon Ink & Chemicals Inc.) and 60 parts of n-propyl alcohol to give a coating liquid. Each of thus obtained coating liquids [A), B) and C) corresponding to the pigment dispersions A), B) and C)] was coated using a whirler on a polyester film (base sheet; thickness: 5 μm, available from Teijin Co., Ltd.) with a back surface having been made easily releasable. Thus, a cyan ink sheet having a support and a cyan ink layer of 0.36 μm, a magenta ink sheet having a support and a magenta ink layer of 0.38 μm, and a yellow ink sheet having a support and a yellow ink layer of 0.42 μm, were prepared.

(2) Preparation of image receiving sheet

The following coating liquids for first and second image receiving layers were prepared:

| | |
|---|---|
| (Coating liquid for first image receiving layer) | |
| Vinyl chloride/vinyl acetate copolymer (MPR-TSL, available from Nisshin Kagaku Co., Ltd.) | 25 parts |
| Dibutyloctyl phthalate (DOP, Daihachi Kagaku Co., Ltd.) | 12 parts |
| Surface active agent (Megafack F-177, available from Dainippon Ink & Chemicals Inc.) | 4 parts |
| Solvent (Methyl ethyl ketone) | 75 parts |
| (Coating liquid for second image receiving layer) | |
| Butyral resin (Denka Butyral #2000-L, available from Denki Kagaku Kogyo K.K.) | 16 parts |
| N,N-dimethylacrylamide/butyl acrylate copolymer | 4 parts |
| Surface active agent (Megafack F-177, available from Dainippon Ink & Chemicals Inc.) | 0.5 parts |
| Solvent (n-propyl alcohol) | 200 parts |

The above coating liquid for first image receiving layer was coated on a polyester film (support sheet) having fine pores therein (thickness: 100 μm; trade name: Rumiler E60, available from Toray Industries, Inc.) using a whirler, and dried for 2 minutes in an oven of 100° C. to form a first image receiving layer (thickness: 20 μm) on the film.

Subsequently, the above coating liquid for second image receiving layer was coated on the first image receiving layer using a whirler, and dried for 2 minutes in an oven of 100° C. to form a second image receiving layer (thickness: 2 μm).

[Image formation using thermal head and its evaluation]

Using the heat sensitive ink sheets and the image receiving sheet obtained in Examples 1, the image formation was performed as follows:

(1) Formation of transferred image (Step 1)

Initially, the cyan heat sensitive ink sheet was superposed on the image receiving sheet, and a thermal head was placed on the cyan ink sheet side for imagewise forming a cyan image by the known divided sub-scanning method. The divided sub-scanning method was performed with multiple modulation for giving area gradation by moving a thermal head of 75 μm×50 μm in one direction at a pitch of 3 μm along 50 μm length. The base sheet (polyester film) of the cyan ink sheet was then peeled off from the image receiving sheet on which a cyan image with area gradation was maintained. On the image receiving sheet having the cyan image was superposed the magenta ink sheet, and the same procedure was repeated for forming a magenta image with area gradation on the image receiving sheet having the cyan image. The yellow ink sheet was then superposed on the image receiving sheet having the cyan and magenta images thereon in the same manner, and the same procedure was repeated for forming a yellow image with area gradation on the image receiving sheet. Thus, a multicolor image was formed on the image receiving layer.

(2) Formation of retransferred image (Step 2)

Subsequently, an art paper sheet was placed on the image receiving sheet having the multicolor image, and they were passed through a couple of heat rollers under conditions of 130° C., 4.5 kg/cm$^2$ and 4 m/sec. Then, the polyester film (support sheet) of the image receiving sheet was peeled off from the art paper sheet to form a multicolor image having the second image receiving layer on the art paper sheet. Thus obtained multicolor image showed high approximation to that of chemical proof (Color Art, available from Fuji Photo Film Co., Ltd.) prepared from a lith manuscript.

The following is optical reflection density of a solid portion of each color image:

Cyan image: 1.53

Magenta image: 1.43

Yellow image 1.58

(3) Evaluation of color image obtained in Step 1

The color image obtained in Step 1 was evaluated on occurrence of line on image, nonuniformity of concentration, resistance to adhesion, running property for auto paper feeding and shape of dot.

i) Shape of dot was ranked based on evaluation of multicolor image (AA) obtained in Example 1, as follows:

(Shape of dot)

BB: a little unsatisfactory compared with dot forming multicolor image of Example 1

CC: unsatisfactory compared with dot forming multicolor image of Example 1 ii) Occurrence of line and nonuniformity of concentration were evaluated by visual observation of ten persons. They were ranked based on evaluation of multicolor image (CC) obtained in Comparison Example 1 (mentioned later), as follows:

AA: Excellent compared with gradation reproduction of multicolor image of Comparison Example 1

BB: Good compared with gradation reproduction of multicolor image of Comparison Example 1 iii) Ten sheets of image receiving sheets were set in a cassette for feeding paper of a printer, and auto paper feeding was performed. The feeding property was observed to be evaluated. It was ranked based on evaluation of feeding property (CC) of the sheet obtained in Comparison Example 1, as follows:

AA: Excellent compared with feeding property of the sheet of Comparison Example 1

BB: Good compared with feeding property of the sheet of Comparison Example 1 iv) Resistance to adhesion was evaluated as follows: Five sheets of image receiving sheets (samples) having a size of 5 cm×5 cm were allowed to stand for one hour in an atmosphere of 23° C., 60% RH. The resultant samples were superposed in the same directions and a pair of glass plates were arranged on both sides of the superposed samples to be fixed. The composite was protected from moisture with wrapping. The composite was allowed to stand for two hours under load of 2 kg. It was observed whether the resultant samples (sheets) was stuck each other or not. The result was ranked based on evaluation of resistance to adhesion (CC) of the sheet obtained in Comparison Example 1, as follows:

AA: Excellent compared with the sheet of Comparison Example 1

BB: Good compared with the sheet of Comparison Example 1

Good resistance to adhesion means that the sheets are not stuck each other.

The results of these evaluation are set forth in Table 4.

EXAMPLES 2–4

The procedures of Example 1 were repeated except for employing as the plastic support of the image receiving sheet plastic supports shown in Table 3 to prepare three kinds of image receiving sheets, and heat sensitive ink sheets (cyan ink sheet, magenta ink sheet and yellow ink sheet).

A multicolor image was prepared in the same manner as Example 1 using the heat sensitive ink sheets and one of the image receiving sheets prepared in the same manner as Example 1. The resultant multicolor image was retransferred onto an art paper sheet in the same manner as Example 1.

Optical reflection density of a solid portion of each color image was the same as Example 1. The other evaluations in Step 1 were the same as Example 1, and the results are set forth in Table 4.

Comparison Examples 1–2

The procedures of Example 1 were repeated except for employing as the plastic support of the image receiving sheet plastic supports shown in Table 3 to prepare three kinds of image receiving sheets, and heat sensitive ink sheets (cyan ink sheet, magenta ink sheet and yellow ink sheet).

A multicolor image was prepared in the same manner as Example 1 using the heat sensitive ink sheets and one of the image receiving sheets prepared in the same manner as Example 1. The resultant multicolor image was retransferred onto an art paper sheet in the same manner as Example 1.

Optical reflection density of a solid portion of each color image was the same as Example 1. The other evaluations in Step 1 were the same as Example 1, and the results are set forth in Table 4.

TABLE 3

| | Support sheet | Thickness (μm) |
|---|---|---|
| Ex. 1 | Polyester film having fine pores (trade name: Lumirror E60, available from Toray Industries, Inc.) | 100 |
| Ex. 2 | Polyester film having fine pores (trade name: Limirror E68L, available from Toray Industries, Inc.) | 100 |
| Ex. 3 | Polyester film having fine pores (trade name: W900E, available from Diawhiel Co., Ltd.) | 100 |
| Ex. 4 | Polyester film having fine pores (trade name: Crysper G1212, available from Toyobo Co., Ltd.) | 125 |
| Co. Ex. 1 | Clear polyethylene terephthalate film (trade name: Lumirror #100, available from Toray Industries, Inc.) | 100 |
| Co. Ex. 2 | White polyethylene terephthalate film having no fine pore (trade name: Lumirror X-20, available from Toray Industries, Inc.) | 125 |

TABLE 4

| | Shape of Dot | Occurrence of line | Nonuniformity of conc. | Resistance to adhesion | Running property |
|---|---|---|---|---|---|
| Ex. 1 | AA | AA | AA | AA | AA |
| Ex. 2 | AA | AA | AA | AA | AA |
| Ex. 3 | AA | AA | AA | AA | AA |
| Ex. 4 | AA | AA | AA | AA | AA |
| Co. Ex. 1 | AA | CC | CC | CC | CC |
| Co. Ex. 2 | AA | CC | CC | BB | BB |

As is apparent from the results of Table 4, the image forming methods using the image receiving sheet having fine pores therein (Examples 1–4) gave transferred images having high quality. Further in the retransferred images obtained from the transferred images, their surfaces were matted by following up unevenness of a paper sheet and therefore the glosses were those which are well analogous to a printed image.

Moreover, a composite of an image receiving sheet and a heat sensitive ink sheet was previously prepared, and then the above image forming method was conducted using the composite. Also in this case, the results of the above evaluations were the same as in Examples 1–4.

EXAMPLE 5

The procedures of Example 1 were repeated except for changing the thickness of the second image receiving layer form 2 μm to 5 μm and forming no first image receiving layer, to prepare an image receiving sheet, and heat sensitive ink sheets (cyan ink sheet, magenta ink sheet and yellow ink sheet).

A multicolor image was prepared in the same manner as Example 1 using the heat sensitive ink sheets and the image receiving sheet prepared in the same manner as Example 1. The resultant multicolor image was retransferred onto an art paper sheet in the same manner as Example 1.

Optical reflection density of a solid portion of each color image was the same as Example 1. The other evaluations in Step 1 were the same as Example 1 except for the following and the results are set forth in Table 6.

Basis of evaluation ranked as "CC" was changed from that obtained in Comparison Example 1 to that obtained in Comparison Example 3 (mentioned later).

Comparison Examples 3–4

The procedures of Example 5 were repeated except for employing as the plastic support of the image receiving sheet plastic supports shown in Table 5 to prepare three kinds of image receiving sheets, and heat sensitive ink sheets (cyan ink sheet, magenta ink sheet and yellow ink sheet).

A multicolor image was prepared in the same manner as Example 1 using the heat sensitive ink sheets and the image receiving sheet prepared in the same manner as Example 1. The resultant multicolor image was retransferred onto an art paper sheet in the same manner as Example 1.

Optical reflection density of a solid portion of each color image was the same as Example 1. The other evaluations in Step 1 were the same as Example 5, and the results are set forth in Table 6.

TABLE 5

| | Support sheet | Thickness (μm) |
|---|---|---|
| Ex. 1 | Polyester film having fine pores (trade name: Lumirror E60, available from Toray Industries, Inc.) | 100 |
| Co. Ex. 3 | Clear polyethylene terephthalate film (trade name: Lumirror #100, available from Toray Industries, Inc.) | 100 |
| Co. Ex. 4 | White polyethylene terephthalate film having no fine pore (trade name: Lumirror X-20, available from Toray Industries, Inc.) | 125 |

TABLE 6

| | Shape of Dot | Occurrence of line | Nonuniformity of conc. | Resistance to adhesion | Running property |
|---|---|---|---|---|---|
| Ex. 1 | BB | BB | BB | BB | BB |
| Co. Ex. 1 | CC | CC | CC | CC | CC |
| Co. Ex. 2 | CC | CC | CC | BB | BB |

As is apparent from the results of Table 6, in the image forming method using the image receiving sheet having fine pores therein, even use of single image receiving layer gave transferred images having relatively high quality.

EXAMPLE 6

Heat sensitive ink sheets and an image receiving sheet were prepared below. Then, a composite of a heat sensitive sheet and an image receiving sheet was irradiated with a laser beam to form a transferred image in the following manner.

(1) Preparation of image receiving sheet

The coating liquid for first image receiving layer were preparedly mixing the following components by the use of a stirrer:

| (Coating liquid for first image receiving layer) | |
|---|---|
| Vinyl chloride copolymer (Zeon 25, available from Nippon Geon Co., Ltd.) | 9 parts |
| Surface active agent (Megafack F-177, available from Dainippon Ink & Chemicals Inc.) | 0.1 part |
| Methyl ethyl ketone | 130 parts |
| Toluene | 35 parts |
| Cyclohexanone | 20 parts |
| Dimethylformamide | 20 parts |

The above coating liquid for first image receiving layer was coated on a polyester film (support sheet) having fine pores therein (thickness: 100 μm; trade name: Lumirror E60L, available from Toray Industries, Inc.) using a whirler, and dried for 2 minutes in an oven of 100° C. to form a first image receiving layer (thickness: 1 μm) on the film.

The coating liquid for second image receiving layer were prepared by mixing the following components by the use of a stirrer:

| (Coating liquid for second image receiving layer) | |
|---|---|
| Methyl methacrylate/ethyl acrylate/methacrylic acid copolymer (Diyanal BR-77, available from Mitsubishi Rayon Co., Ltd.) | 17 parts |
| Alkyl acrylate/alkyl methacrylate copolymer (Diyanal BR-64, available from Mitsubishi Rayon Co., Ltd.) | 17 parts |
| Pentaerythritol tetraacrylate (A-TMMTN, available from Shi Nakamura Kagaku Co., Ltd.) | 22 parts |
| Surface active agent (Megafack F-177, available from Dainippon Ink & Chemicals Inc.) | 0.4 part |
| Methyl ethyl ketone | 100 parts |
| Hydroquinone monomethyl ether | 0.05 part |
| Photopolymerization initiator (2,2-dimethoxy-2-phenylacetophenone) | 1.5 parts |

Subsequently, the above coating liquid for second image receiving layer was coated on the first image receiving layer using a whirler, and dried for 2 minutes in an oven of 100° C. to form a second image receiving layer (thickness: 25 μm).

(2) Preparation of heat sensitive ink sheet

1) Preparation of coating liquid for light-heat conversion layer

The following components were mixed using a stirrer to prepare a coating liquid for light-heat conversion layer:

| | |
|---|---|
| Dye absorbing infrared ray (IR-820, available from Nippo Kayaku Co., Ltd.) | 1.7 part |
| Varnish of polyamic acid (PAA-A, available from Mitsui Toatsu Chemicals, Inc.) | 13 parts |
| 1-Methoxy-2-propanol | 60 parts |
| Methyl ethyl ketone | 88 parts |
| Surface active agent (Megafack F-177, available from Dainippon Ink & Chemicals Inc.) | 0.05 part |

2) Formation of light-heat conversion layer

A first subbing layer comprising styrene/butadiene copolymer (thickness: 0.5 μm ) and a second subbing layer comprising gelatin (thickness: 0.1 μm) were formed on a polyethylene terephthalate film (base sheet; thickness: 75 μm) in order. Then, the above coating liquid for light-heat conversion layer was coated on the second subbing layer using a whirler, and dried for 2 minutes in an oven of 100° C. to form a light-heat conversion layer (thickness: 0.2 μm (measured by feeler-type thickness meter, absorbance of light of 830 nm: 1.4)).

3) Preparation of coating liquid for heat sensitive peeling layer

The following components were mixed using a stirrer to prepare a coating liquid for heat sensitive peeling layer:

| | |
|---|---|
| Nitrocellulose (HIG120, available from Asahi Chemical Co., Ltd.) | 1.3 part |
| Methyl ethyl ketone | 26 parts |
| Propylene glycol monomethylether acetate | 40 parts |
| Toluene | 92 parts |
| Surface active agent (Megafack F-177, available from Dainippon Ink & Chemicals Inc.) | 0.01 part |

4) Formation of heat sensitive peeling layer

The above coating liquid for heat sensitive peeling layer was coated on the light-heat conversion layer using a whirler, and dried for 2 minutes in an oven of 100° C. to form a heat sensitive peeling layer (thickness: 0.1 μm (measured by feeler-type thickness meter a layer formed by coating the liquid on a surface of a hard sheet in the same manner as above)).

5) Preparation of coating liquid for heat sensitive ink layer (image forming layer) of magenta The following components were mixed using a stirrer to prepare a coating liquid for heat sensitive ink layer for magenta image:

Preparation of mother liquor

| | |
|---|---|
| Polyvinyl butyral (Denka Butyral #2000-L available from Denki Kagaku Kogyo K.K.) | 12.6 parts |
| Magenta pigments (C.I. P.R. 57:1) | 18 parts |
| Dispersing agent (Solspers S-20000, available from ICI Japan Co., Ltd.) | 0.8 part |
| n-Propyl alcohol | 110 parts |
| Glass beads | 100 parts |

The above materials were placed in a paint shaker (available from Toyo Seiki Co., Ltd.) and were subjected to dispersing treatment for two hours to prepare the mother liquor. The obtained mother liquor was diluted with n-propyl alcohol, and particle size distribution of the pigments in the diluted liquid was measured by a particle size measuring apparatus (utilizing laser beam scattering system). The measurement showed that the pigments of not less than 70 weight % had particle size of 180 to 300 nm.

Preparation of coating liquid

| | |
|---|---|
| Mother liquor prepared above | 6 parts |
| n-Propyl alcohol | 60 parts |
| Surface active agent (Megafack F-177, available from Dainippon Ink & Chemicals Inc.) | 0.01 part |

The above components were mixed with a stirrer to prepare a coating liquid for forming a heat sensitive ink layer of magenta.

6) Formation of heat sensitive ink layer of magenta

The above coating liquid for heat sensitive ink layer of magenta image was coated on the heat sensitive peeling layer using a whirler, and dried for 2 minutes in an oven of 100° C. to form a heat sensitive ink layer (thickness: 0.3 μm (measured by feeler-type thickness meter a layer formed by coating the liquid on a surface of a hard sheet in the same manner as above)). The obtained ink layer showed optical transmission density of 0.7 (measured by Macbeth densitometer using green filter).

Thus, a heat sensitive ink sheet (magenta image) composed of a base sheet, a light-heat conversion layer, a heat sensitive peeling layer and heat sensitive ink layer of magenta image, was prepared.

[Formation of image by laser beam and evaluation]

(3) Preparation of Composite for Forming Image

The above heat sensitive ink sheet and the above image receiving sheet were allowed to stand at room temperature for one day, and they were placed at room temperature in such a manner that the heat sensitive ink and the second image receiving layer came into contact with each other and passed through a couple of heat rollers under conditions of 70° C., 4.5 kg/cm$^2$ and 2 m/sec. to form a composite. Temperatures of the sheets when passed through the rollers were measured by a thermocouple. The temperatures each were approx. 50° C.

(4) Fixation of composite on image forming device

The above composite was cooled at room temperature for 10 minutes. Then, the composite was wound around a rotating drum provided with a number of suction holes in such a manner that the image receiving sheet was in contact with a surface of the rotating drum, and the composite was fixed on the rotating drum by sucking inside of the drum.

(5) Image recording

The laser beam (λ:830 nm, out-put power:110 mW) was focused at a beam diameter of 7 μm on the surface of the light-heat conversion layer of the composite to record a image (line), while, by rotating the drum, the laser beam was moved in the direction (sub-scanning direction) perpendicular to the rotating direction (main-scanning direction).

Main-scanning rate: 10 m/sec.

Sub-scanning pitch (Sub-scanning amount per one time): 5 μm (6) Formation of transferred image The recorded composite was removed from the drum, and the heat sensitive ink sheet was peeled off from the image receiving sheet by hand to obtain the image receiving sheet having the transferred image (lines) of the heat sensitive ink material wherein lines of magenta having width of 5.0 μm were formed in only the irradiation portion of the laser beam.

The resultant transferred image had a high concentration, no nonuniformity of concentration and no image defect (existence of no image portion on the image).

EXAMPLE 7

(1) Preparation of image receiving sheet

The same coating liquid for first image receiving layer as in Example 1 was coated on a polyester film having fine pores therein (thickness: 100 μm; trade name: Lumirror E60L, available from Toray industries, Inc.) using a whirler, and dried for 2 minutes in an oven of 100° C. to form a first image receiving layer/thickness: 20 μm) on the film.

Subsequently, the same coating liquid for second image receiving layer as in Example 1 was coated on the first image receiving layer using a whirler, and dried for 2 minutes in an oven of 100° C. to form a second image receiving layer (thickness: 2 μm).

[Formation of image by laser beam and evaluation]

Using the above image receiving sheet and the same heat sensitive ink layer as in Example 6, the procedures (3) to (6) in Example 6 were repeated to form a transferred image on the image receiving sheet.

The resultant transferred image had a high concentration, no nonuniformity of concentration and no image defect (existence of no image portion on the image), which was the same as in Example 6.

Comparison Example 5

(1) Preparation of image receiving sheet

The procedures of Example 6 were repeated except for employing as the plastic support of the image receiving sheet plastic support Clear polyethylene terephthalate film having no pore (thickness; 100 μm; trade name: Rumiler #100, available from Toray Industries, inc.) to prepare an image receiving sheet.

[Formation of image by laser beam and evaluation]

Using the above image receiving sheet and the same heat sensitive ink layer as in Example 6, the procedures (3) to (6)

in Example 6 were repeated to form a transferred image on the image receiving sheet.

The resultant transferred image had a low concentration, nonuniformity of concentration and some image defects (existence of no image portions on the image) compared with in Example 6 or 7. Further, width of image line of the transferred image was 4 μm, which was lower than that of Example 6.

What is claimed is:

1. An image forming method which comprises the steps of:

superposing a heat sensitive ink sheet having a base sheet and a heat sensitive ink layer thereon on an image receiving sheet having a support sheet and an image receiving layer thereon in such a manner that the heat sensitive ink layer is in contact with the image receiving layer, said heat sensitive ink layer of the heat sensitive ink sheet having a thickness of 0.2 to 1.0 μm and being formed of a heat sensitive ink material which comprises 30 to 70 weight % of colored pigment and 25 to 65 weight % of amorphous organic polymer having a softening point of 40° to 150° C., and said support sheet of the image receiving sheet comprising a porous sheet made of plastics;

placing imagewise a thermal head on the base sheet of the heat sensitive ink sheet to form an image of the ink material with area gradation on the image receiving layer; and separating the base sheet of the heat sensitive ink sheet from the image receiving sheet so that the image of the ink material can be retained on the image receiving layer, said image of the ink material on the image receiving layer having an optical reflection density of at least 1.0.

2. The image forming method as defined in claim 1, which further contains the steps of:

superposing the image receiving sheet having the image on a white paper sheet in such a manner that the image of the ink material is in contact with a surface of the white paper sheet; and separating the image receiving sheet from the white paper sheet, keeping the image of the ink material on the white paper sheet, said image of the ink material on the white paper sheet having an optical reflection density of at least 1.0.

3. The image forming method as defined in claim 1, wherein at least 70 weight % of the colored pigment has a particle size of 0.1 to 1.0 μm.

4. The image forming method as defined in claim 1, wherein the support sheet of the image receiving sheet is made of at least one material selected from the group consisting of polyester, polyamide, polycarbonate, polyethersulfone, polyimide, polyolefin, polyvinyl chloride, polyurethane, polyvinylidene chloride, polyacrylate and cellulose acetate.

5. The image forming method as defined in claim 1, wherein the support sheet of the image receiving sheet has a thickness of 50 to 250 μm.

6. The image forming method as defined in claim 1, wherein the support sheet of the image receiving sheet is a porous sheet which is sandwiched between a backing layer and an anti-curling layer.

7. The image forming method as defined in claim 1, wherein the image receiving layer of the image receiving sheet comprises two layers.

8. A composite in which comprises an image receiving sheet having a support sheet and an image receiving layer thereon and a heat sensitive ink sheet having a base sheet and a heat sensitive ink layer thereon which are superposed in such a manner that the heat sensitive ink layer is in contact with the image receiving layer, said heat sensitive ink layer of the heat sensitive ink sheet having a thickness of 0.2 to 1.0 μm and being formed of a heat sensitive ink material comprising 30 to 70 weight % of colored pigment and 25 to 65 weight % of amorphous organic polymer having a softening point of 40° to 150° C., and said support sheet of the image receiving sheet comprising a porous sheet made of plastics.

9. An image forming method which comprises the steps of:

superposing a heat sensitive ink sheet having a base sheet and a heat sensitive ink layer thereon on an image receiving sheet having a support sheet and an image receiving layer thereon in such a manner that the heat sensitive ink layer is in contact with the image receiving layer, said heat sensitive ink layer of the heat sensitive ink sheet being formed of a heat sensitive ink material which comprises colored pigment and thermoplastic resin and said support sheet of the image receiving sheet comprising a porous sheet made of plastics;

irradiating a laser beam modulated by digital signals on the heat sensitive ink layer through the base sheet of the heat sensitive ink sheet to form an image of the ink material on the image receiving layer; and separating the base sheet of the heat sensitive ink sheet from the image receiving sheet so that the image of the ink material can be retained on the image receiving sheet.

10. The image forming method as defined in claim 9, wherein the formation of the image of the ink material on the image receiving sheet is done by ablation of the image from the base support of the heat sensitive ink sheet.

11. The image forming method as defined in claim 9, wherein further contains the steps of:

superposing the image receiving sheet having the image on a white paper sheet in such a manner that the image of the ink material is in contact with a surface of the white paper sheet; and separating the image receiving sheet from the white paper sheet, keeping the image of the ink material on the white paper sheet.

12. The image forming method as defined in claim 9, wherein the support sheet of the image receiving sheet is made of at least one material selected from the group consisting of polyester, polyamide, polycarbonate, polyethersulfone, polyimide, polyolefin, polyvinyl chloride, polyurethane, polyvinylidene chloride, polyacrylate and cellulose acetate.

13. The image forming method as defined in claim 9, said support sheet of the image receiving sheet has a thickness of 50 to 300 μm.

14. The image forming method as defined in claim 9, wherein the support sheet of the image receiving sheet is a porous sheet which is sandwiched between a backing layer and an anti-curling layer.

15. The image forming method as defined in claim 9, wherein said heat sensitive ink layer of the heat sensitive ink sheet is formed of a heat sensitive ink material comprising 30 to 70 weight % of colored pigment and 30 to 70 weight % of thermoplastic resin.

16. The image forming method as defined in claim 9, wherein said thermoplastic resin is amorphous organic polymer having a softening point of 40 to 150° C.

17. The image forming method as defined in claim 9, wherein said heat sensitive ink layer of the heat sensitive ink sheet has a thickness of 0.2 to 1.5 μm.

18. The image forming method as defined in claim 9, wherein the heat sensitive ink sheet further has a light-heat conversion layer between the base sheet and the heat sensitive ink layer.

19. The image forming method as defined in claim 9, wherein in the step of superposing a heat sensitive ink sheet on an image receiving sheet, the superposing is conducted in the application of pressure of 1 to 30 kg/cm$^2$.

* * * * *